US009644887B2

(12) United States Patent
Chung et al.

(10) Patent No.: US 9,644,887 B2
(45) Date of Patent: May 9, 2017

(54) HEAT EXCHANGER ASSEMBLY, REFRIGERATOR, AND METHOD OF CONTROLLING A REFRIGERATOR

(71) Applicant: LG ELECTRONICS INC., Seoul (KR)

(72) Inventors: Myungjin Chung, Seoul (KR); Hyokeun Park, Seoul (KR); Jangseok Lee, Seoul (KR); Sangbong Lee, Seoul (KR); Hyoungkeun Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 212 days.

(21) Appl. No.: 14/337,691

(22) Filed: Jul. 22, 2014

(65) Prior Publication Data

US 2015/0027148 A1 Jan. 29, 2015

(30) Foreign Application Priority Data

Jul. 24, 2013 (KR) ..... 10-2013-0087222
Mar. 10, 2014 (KR) ..... 10-2014-0027639

(51) Int. Cl.
*F25D 29/00* (2006.01)
*F25D 11/02* (2006.01)
*F25D 17/06* (2006.01)

(52) U.S. Cl.
CPC ..... *F25D 29/005* (2013.01); *F25D 11/022* (2013.01); *F25D 17/062* (2013.01);
(Continued)

(58) Field of Classification Search
CPC .. F25D 29/005; F25D 2700/10; F25D 17/067; F25D 17/062; F25D 11/022; F25B 2700/21174; F25B 2700/21175
See application file for complete search history.

(56) References Cited

U.S. PATENT DOCUMENTS 6,438,978 B1 * 8/2002 Bessler ..... F25B 5/04 62/179
2008/0008227 A1 * 1/2008 Jang ..... G01K 1/14 374/208

FOREIGN PATENT DOCUMENTS

CN 1598457 A 3/2005
EP 1 462 740 A2 9/2004
(Continued)

OTHER PUBLICATIONS

European Search issued in Application No. 14177573.4 dated Feb. 23, 2015.
(Continued)

*Primary Examiner* — Emmanuel Duke
(74) *Attorney, Agent, or Firm* — Ked & Associates LLP

(57) ABSTRACT

A heat exchanger assembly, a refrigerator, and a method of controlling a refrigerator are provided. The heat exchanger assembly may include a heat exchanger provided on or at a side of a refrigerator body, the heat exchanger including a refrigerant tube, in which a refrigerant may flow, and at least one heat exchange fin, in which the refrigerant tube may be inserted, a temperature sensor disposed on or at an inlet-side or an outlet-side of the heat exchanger to detect a temperature of the refrigerant, and a sensor holder to fix a guide tube disposed on or at an inlet-side or outlet-side of the refrigerant tube and the temperature sensor in a state in which the guide tube is in contact with the temperature sensor.

7 Claims, 34 Drawing Sheets

(52) U.S. Cl.
CPC .. *F25D 17/067* (2013.01); *F25B 2700/21174* (2013.01); *F25B 2700/21175* (2013.01); *F25D 2700/10* (2013.01)

(56) References Cited

FOREIGN PATENT DOCUMENTS

| | | | | |
|---|---|---|---|---|
| JP | S51-161659 | U | | 12/1976 |
| JP | 54-13046 | | | 1/1979 |
| JP | 5413046 | | * | 1/1979 |
| JP | 57-11487 | | | 1/1982 |
| JP | S57-091080 | U | | 6/1982 |
| JP | S62-019577 | U | | 2/1987 |
| JP | 10153491 | | * | 6/1998 |
| JP | H10153491 | A | | 6/1998 |
| JP | 2002-005751 | | | 1/2002 |
| JP | 2002005751 | A | * | 1/2002 |
| JP | 2002098476 | A | * | 4/2002 |
| JP | 2004-053059 | | | 2/2004 |
| JP | 2004-060997 | | | 2/2004 |
| JP | 2004060997 | A | * | 2/2004 |
| JP | 2010196923 | A | * | 9/2010 |
| JP | 2011058738 | A | * | 3/2011 |
| KR | 20-1999-0027598 | | | 7/1999 |
| KR | 20010063559 | A | * | 7/2001 |
| KR | 10-2004-0038311 | | | 5/2004 |

OTHER PUBLICATIONS

Chinese Office Action dated Feb. 16, 2016 issued in Application No. 201410356850.5 (English Translation).
Korean Office Action dated Oct. 2, 2015.
Korean Notice of Allowance dated Jul. 27, 2016 issued in Application No. 10-2014-0027639.

* cited by examiner

Related Art

HEAT EXCHANGER ASSEMBLY, REFRIGERATOR, AND METHOD OF CONTROLLING A REFRIGERATOR

CROSS-REFERENCE TO RELATED APPLICATION(S)

The present application claims priority under 35 U.S.C. 119 and 35 U.S.C. 365 to Korean Patent Application No. 10-2013-0087222 filed in Korea on Jul. 24, 2013, and No. 10-2014-0027639 filed in Korea on Mar. 10, 2014, which are hereby incorporated by reference in their entirety.

BACKGROUND

1. Field

A heat exchanger assembly, a refrigerator, and a method of controlling a refrigerator are disclosed herein.

2. Background

A heat exchanger may used in a refrigerator, as one component of a refrigeration cycle. The heat exchanger may include a refrigerant tube, in which a refrigerant may flow, and a heat exchange fin coupled to the refrigerant tube so that the refrigerant is heat-exchanged with external air. The heat exchange fin may be coupled to the refrigerant tube to increase a heat exchange area between the refrigerant and the external air.

The heat exchanger may function as a condenser or an evaporator. When the heat exchanger functions as a condenser, a high-pressure refrigerant compressed by a compressor may flow into the refrigerant tube and be heat-exchanged (heat dissipation) with external air, thereby being condensed. The condenser may be disposed in a machine room of the refrigerator.

On the other hand, when the heat exchanger functions as an evaporator, a low-pressure refrigerant may flow into the refrigerant tube and be heat-exchanged (heat absorption) with external air, thereby being evaporated. The evaporator may be disposed adjacent to a cooling compartment to form a low-temperature atmosphere, that is, a refrigerating compartment or freezing compartment to supply cold air into the cooling compartment.

A temperature sensor to detect a temperature of the refrigerant introduced into the heat exchanger or a temperature of the refrigerant discharged from the heat exchanger may be disposed on an inlet side or outlet side of the heat exchanger.

FIG. 33 illustrates a holder to fix a temperature sensor to a refrigerant tube according to the related art. Referring to FIG. 33, according to the related art, a holder 3 is disposed between a refrigerant tube 1 and a temperature sensor 2 to fix the temperature sensor 2 to the refrigerant tube 1. However, as the temperature sensor 2 does not directly contact the refrigerant tube 1, it may be difficult to accurately detect a temperature of the refrigerant flowing in the refrigerant tube 1 by the temperature sensor 2. Also, when the refrigerant tube 1 is a tube of a condenser or an evaporator, hot or cold air around the temperature sensor 2 may act on the temperature sensor 2 to cause a large error between the detected temperature and an actual temperature of the refrigerant.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. Embodiments may, however, be embodied in many different forms and should not be construed as being limited to the embodiments set forth herein; rather, that alternate embodiments included in other retrogressive inventions or falling within the spirit and scope will fully convey the concept to those skilled in the art.

Figure 1:
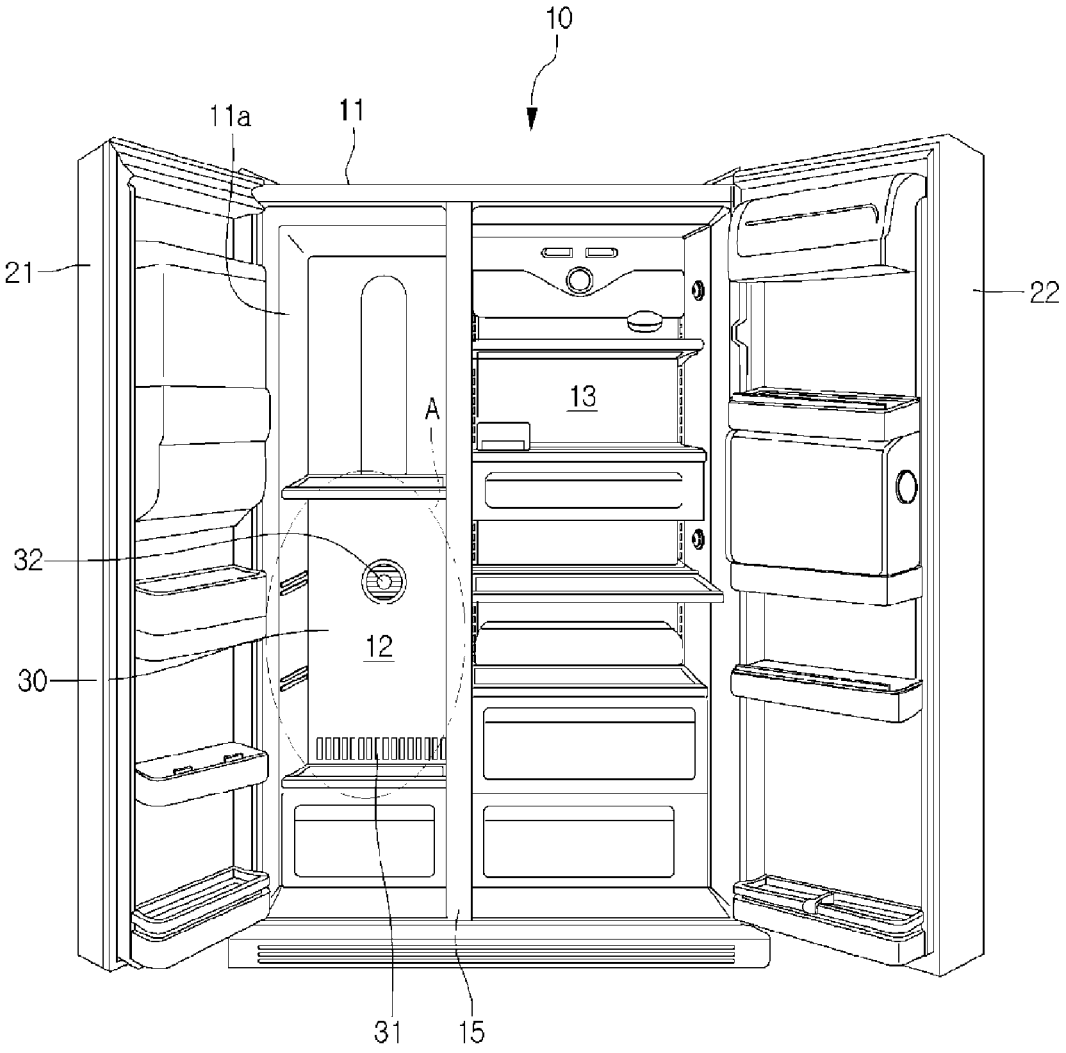
FIG. 1 is a front view of a refrigerator according to an embodiment.
Figure 2:
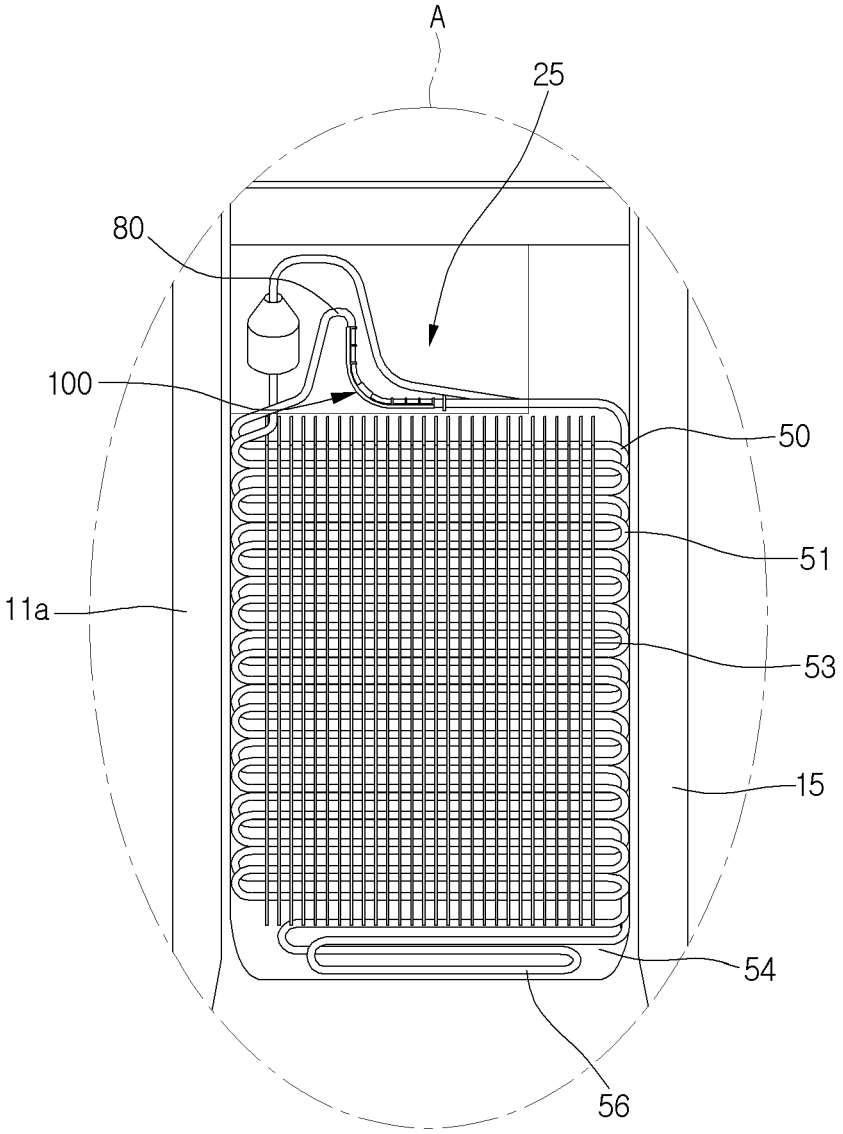
FIG. 2 is a view of a heat exchanger assembly of the refrigerator of FIG. 1.

FIG. 1 is a front view of a refrigerator according to an embodiment. FIG. 2 is a view of a heat exchanger assembly of the refrigerator of FIG. 1.

Referring to FIGS. 1 to 2, a refrigerator 10 according to this embodiment may include a main body 11 that defines a storage compartment and having an open front side. The storage compartment may include a freezing compartment 12 and a refrigerating compartment 13. The freezing compartment 12 and the refrigerating compartment 13 may be partitioned by a partition 15.

The main body 11 may include an inner case 11*a* that defines at least one surface of the storage compartment, that is, an inner side surface of the main body 11. An exterior of the inside of the storage compartment may be defined by the inner case 11*a*.

The refrigerator 10 may further include a freezing compartment door 21 and a refrigerating compartment door 22, which may be rotatably coupled to a front portion of the main body 11 to selectively close or open the freezing compartment 12 and the refrigerating compartment 13, respectively.

In this embodiment, a side by side type refrigerator in which a freezing compartment and a refrigerating compartment are disposed on left and right sides will be described as an example. However, embodiments may be applied to other types of refrigerators, such as a top mount type refrigerator, in which a freezing compartment is defined above a refrigerating compartment, or a bottom freezer type refrigerator, in which a freezing compartment is defined below a refrigerating compartment, in addition to the above-described structure of the refrigerator.

A cold air discharge 32 to discharge cold air generated in a heat exchanger 50 into the freezing compartment 12 may be disposed in the freezing compartment 12. The cold air discharge 32 may be provided on a rear surface of the freezing compartment 12 and be disposed on a cover plate 30. Also, the heat exchanger 50 may be disposed at a rear side of the cover plate 30.

In this embodiment, the heat exchanger 50 may function as an evaporator to generate cold air. Hereinafter, the heat exchanger 50, which may function as the evaporator, will be described as an example. However, embodiments are not limited to the heat exchanger 50, which may function as the evaporator. For example, the heat exchanger 50 may function as a condenser. FIG. 2 is a view illustrating components at a rear side of the cover plate 30.

A cold air inflow 31, through which cold air may be circulated from the freezing compartment 12 to the heat exchanger 50, may be disposed in the cover plate 30. The cold air inflow 31 may be disposed on or at a lower portion of the cover plate 30.

The cold air generated in the heat exchanger 50 may be discharged into the freezing compartment 12 through the cold air discharge 32. The cold air circulated in the freezing compartment 12 may flow to the heat exchanger 50 through the cold air inflow 31 and then be cooled again.

The heat exchanger 50 may include a refrigerant tube 51, through which a refrigerant may flow, and at least one heat exchange fin 53, in which the refrigerant tube 51 may be inserted, for easily heat-exchanging the refrigerant with surrounding air.

A heater 56 to remove frost attached to a surface of the heat exchanger 50 may be disposed under the heat exchanger 50. For example, the heater 56 may include a defrost heater. The heater 56 may operate in a state in which heat exchange in the heat exchanger 50 is stopped to supply heat into the heat exchanger 50, thereby removing frost. A defrost water bucket 54 to collect defrost water generated in the defrosting process of the heat exchanger 50 may be disposed under the heat exchanger 50.

A temperature sensor (see reference numeral 150 of FIG. 4) to detect a temperature of a refrigerant (an inlet side refrigerant) introduced into the heat exchanger 50 or a refrigerant (an outlet side refrigerant) heat-exchanged while passing through the heat exchanger 50, and a sensor holder 100 to fix the temperature sensor 150 to a guide tube 80 may be disposed on or at a side of the heat exchanger 50.

The guide tube 80 may include an inlet tube to guide the introduction of the refrigerant into the heat exchanger 50 and an outlet tube to guide the discharge of the refrigerant from the heat exchanger 50. The inlet tube and the outlet tube may be a portion of the refrigerant tube 51. For example, FIG. 2 illustrates a state in which the sensor holder 100 is coupled to the inlet tube.

Hereinafter, a sensor holder according to embodiments will be described.

Figure 3:
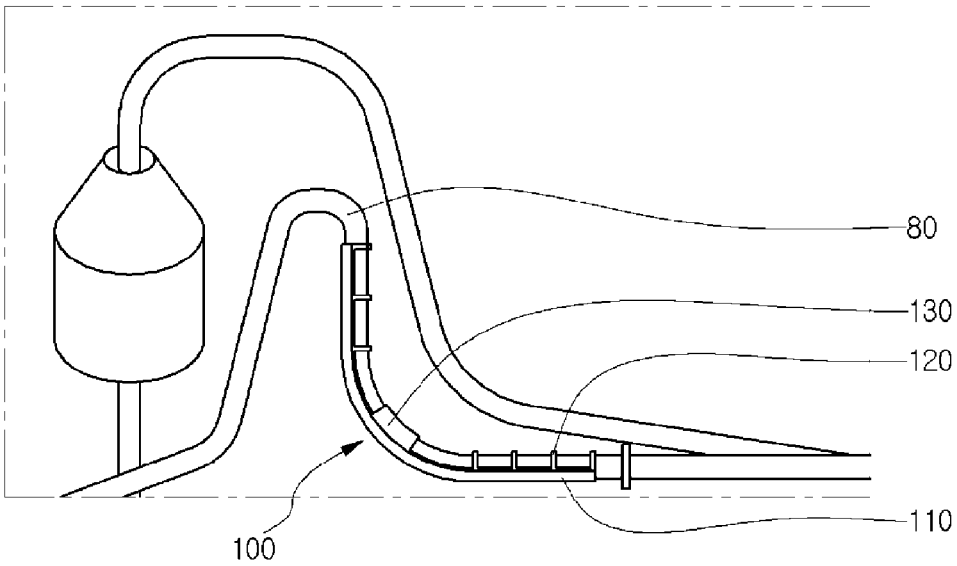
FIG. 3 is a view illustrating a state in which a sensor holder is coupled to a refrigerant tube of a heat exchanger of the heat exchanger assembly of FIG. 2.
Figure 4:
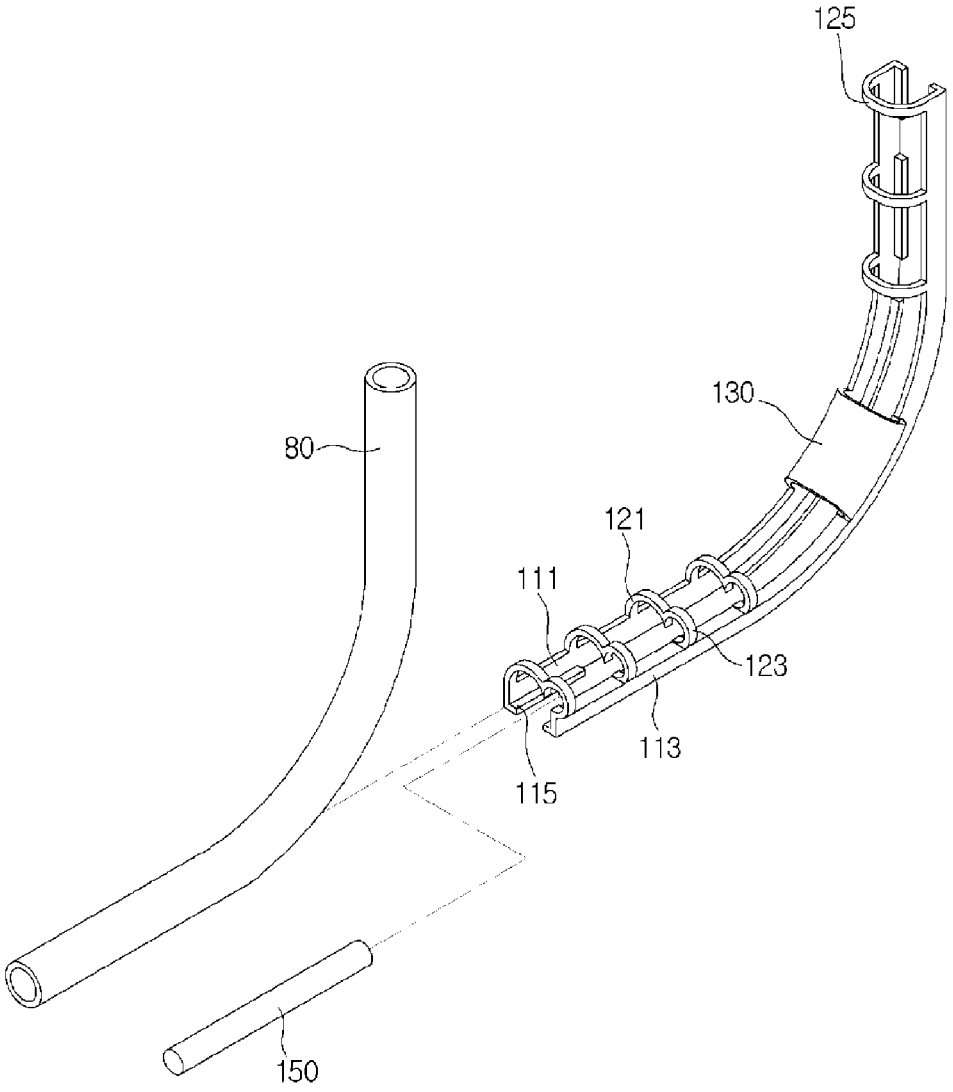
FIG. 4 is an exploded perspective view of a guide tube, temperature sensor, and sensor holder of FIG. 3.
Figure 5:
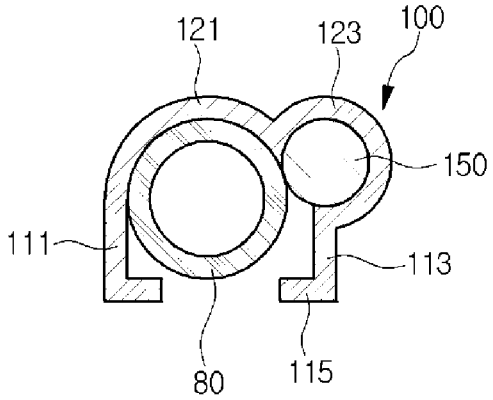
FIG. 5 is a cross-sectional view illustrating a state in which the refrigerant tube and the temperature sensor of FIG. 4 contact each other.

FIG. 3 is a view illustrating a state in which a sensor holder is coupled to the refrigerant tube of the heat exchanger of the heat exchanger assembly of FIG. 2. FIG. 4 is an exploded perspective view of the guide tube, temperature sensor, and sensor holder of FIG. 3. FIG. 5 is a cross-sectional view illustrating a state in which the refrigerant tube and the temperature sensor of FIG. 4 contact each other.

Referring to FIGS. 3 and 5, a heat exchanger assembly 25 according to this embodiment may include guide tube 80 and temperature sensor 150 disposed on or at a side of the guide tube 80. The heat exchanger assembly 25 may further include sensor holder 100 coupled to the guide tube 80 and the temperature sensor 150 to maintain a state in which the guide tube 80 is in contact with the temperature sensor 150. The guide tube 80 may be rounded. As the guide tube 80 may be rounded, space utilization may be improved.

The sensor holder 100 may include a frame 110 that supports the guide tube 80 and the temperature sensor 150, at least one fixing rib 120 to fix the guide tube 80 and the temperature sensor 150 in a state in which the at least one fixing rib 120 is in contact with an outer circumferential surface of the guide tube 80 and an outer circumferential surface of the temperature sensor 150, and a reinforcing rib 130 to reinforce the frame 110.

The frame 110 may include a plurality of frames 111 and 113. The plurality of frames 111 and 113 may include a first frame 111 and a second frame 113, which may be spaced apart from each other.

A space in which the guide tube 80 may be disposed may be defined in a space between the first and second frames 111 and 113. Each of the first and second frames 111 and 113 may be rounded to correspond to a shape of the guide tube 80.

The reinforcing rib 130 may be disposed to connect the first and second frames 111 and 113 to each other. That is, the reinforcing rib 130 may extend from the first frame 111 to the second frame 113.

The guide tube 80 and the temperature sensor 150 may be disposed in the space between the first and second frames 111 and 113. A support protrusion 115 to support the guide tube 80 may be disposed on a lower portion of each of the first and second frames 111 and 113.

That is, a first support protrusion 115 may extend from a surface of the first frame 111 toward the second frame 113, and a second support protrusion 115 may extend from a surface of the second frame 113 toward the first frame 111. Also, the first support protrusion 115 and the second support protrusion 115 may be spaced apart from each other to face each other. As the plurality of support protrusions 115 may be provided on the first and second frames 111 to support the guide tube 80, it may prevent the guide tube 80 from being separated from the first and second frames 111 and 113.

At least one fixing rib 120 may extend from each of the first and second frames 111 and 113 to support at least a portion of each of the guide tube 80 and the temperature sensor 150. In detail, the at least one fixing rib 120 may include at least one tube rib 121 that extends from the first frame 111 to support the guide tube 80, and at least one sensor rib 123 that extends from the second frame 113 to support the temperature sensor 150.

The at least one tube rib 121 may include a plurality of tube ribs 121. The plurality of tube ribs 121 may be spaced apart from each other. The at least one sensor rib 123 may include a plurality of sensor ribs 123. The plurality of sensor ribs 123 may be spaced apart from each other.

The plurality of tube ribs 121 may surround at least a portion of an outer circumferential surface of the guide tube 80, and the plurality of sensor ribs 123 may surround at least a portion of an outer circumferential surface of the temperature sensor 150. For example, each of the tube ribs 121 and the sensor ribs 123 may be rounded.

Each tube rib 121 may have a first curvature radius to correspond to a size of the guide tube 80, and each sensor rib 123 may have a second curvature radius to correspond to a size of the temperature sensor 150. The first curvature radius and the second curvature radius may be different from each other.

Each tube rib 121 may be coupled to one sensor rib 123. For example, an end of the tube rib 121 may be coupled to an end of the sensor rib 123.

The support protrusion 115 and the tube rib 121 may be disposed on side surfaces facing each other with respect to the first frame 111. Thus, the support protrusion 115 may support a first side of the guide tube 80, and the tube rib 121 may support a second side of the guide tube 80. The first side and the second side may be disposed on opposite sides to each other.

Referring to FIG. 5, the guide tube 80 may be supported by or be in contact with the first frame 111, the at least one tube rib 121, and the support protrusion 115. The temperature sensor 150 may be supported by or be in contact with the second frame 113, the sensor rib 123, and the guide tube 80. More particularly, the outer circumferential surface of the temperature sensor 150 and the outer circumferential surface of the guide tube 80 may be in surface-contact or line-contact with each other.

The temperature sensor 150 may be disposed in a space that is defined by the guide tube 80, the at least one sensor rib 123, and the second frame 113. Further, the temperature sensor 150 may be disposed between the guide tube 80 and the at least one sensor rib 123 and be supported by the guide tube 80 and the at least one sensor rib 123.

Thus, a separate coupling member to fix the temperature sensor 150 to the second frame 113 or the at least one sensor rib 123 is unnecessary, as the temperature sensor 150 may be inserted into the space between the guide tube 80 and the at least one sensor rib 123, and thus, be naturally fixed to an outside of the guide tube 80.

The at least one fixing rib 120 may further include at least one guide rib 125 spaced apart from the at least one tube rib 121 and the at least one sensor rib 123 to support the guide tube 80. The at least one guide rib 125 may be understood as a rib that supports a portion of the guide tube 80 which is not in contact with the temperature sensor 150. Each of the at least one guide rib 125 may extend from the first frame 111 to the second frame 113 and be rounded in an approximately semicircular shape.

Hereinafter, additional embodiments will be described. As the embodiments are the same as the previous embodiment except for certain components, only the differences will be described, and descriptions of like components will be denoted by the same or like reference numerals and repetitive descriptions will be omitted.

Figure 6:
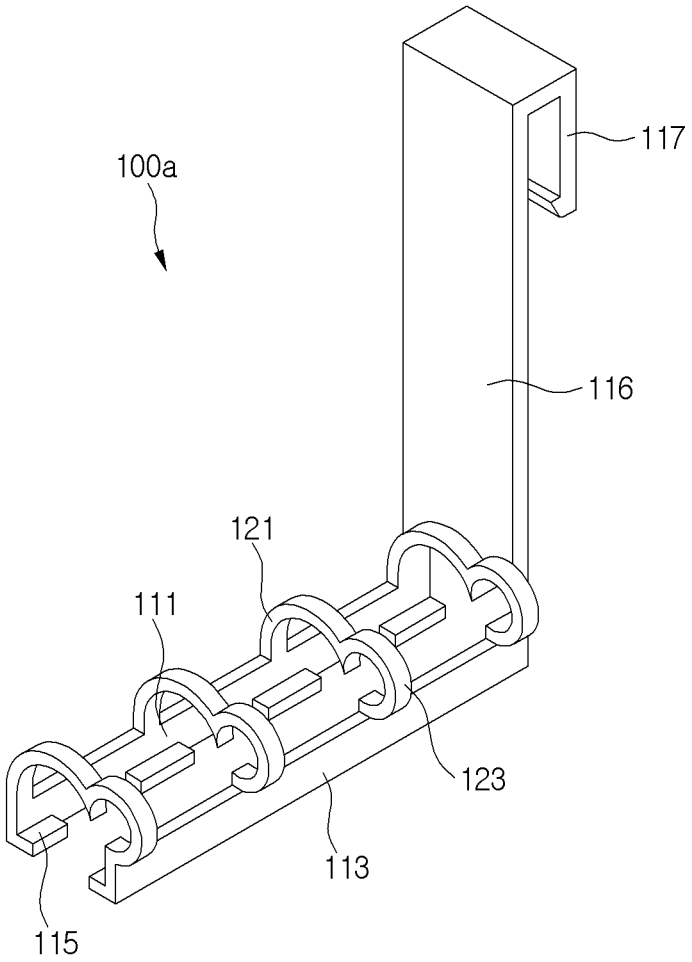
FIG. 6 is a perspective view of a sensor holder according to another embodiment.

FIG. 6 is a perspective view of a sensor holder according to another embodiment. Referring to FIG. 6, a sensor holder 100*a* according to this embodiment may include first frame 111, second frame 113, support protrusion(s) 115, at least one tube rib 121, and at least one sensor rib 123, as described above with respect to the previous embodiment.

The sensor holder 100*a* according to this embodiment may be coupled to a guide tube 80 having a linear shape. The temperature sensor 150 may be disposed to contact an outside of the linear guide tube 80. Also, the at least one tube rib 121 may be disposed to surround at least a portion of the guide tube 80, and the at least one sensor rib 123 may be disposed to surround at least a portion of the temperature sensor 150.

The sensor holder 100*a* according to this embodiment may further include a support bracket 116 that extends from the first and second frames 111 and 113 to fix the holder to a side of heat exchanger 50. The support bracket 116 may be bent from the first and second frames 111 and 113 to extend in one direction.

A hook 117 may be disposed on the support bracket 116. The hook 118 may have a hook shape to be hooked on a predetermined structure. For example, the hook 117 may be hooked on a hook plate (not shown) disposed on an inner case 11*a* of a refrigerator body 11 (see FIG. 1).

According to this embodiment, as the sensor holder may be firmly fixed to or at one side of heat exchanger 50, contact between the guide tube 80 and the temperature sensor 150 may be maintained.

Figure 7:
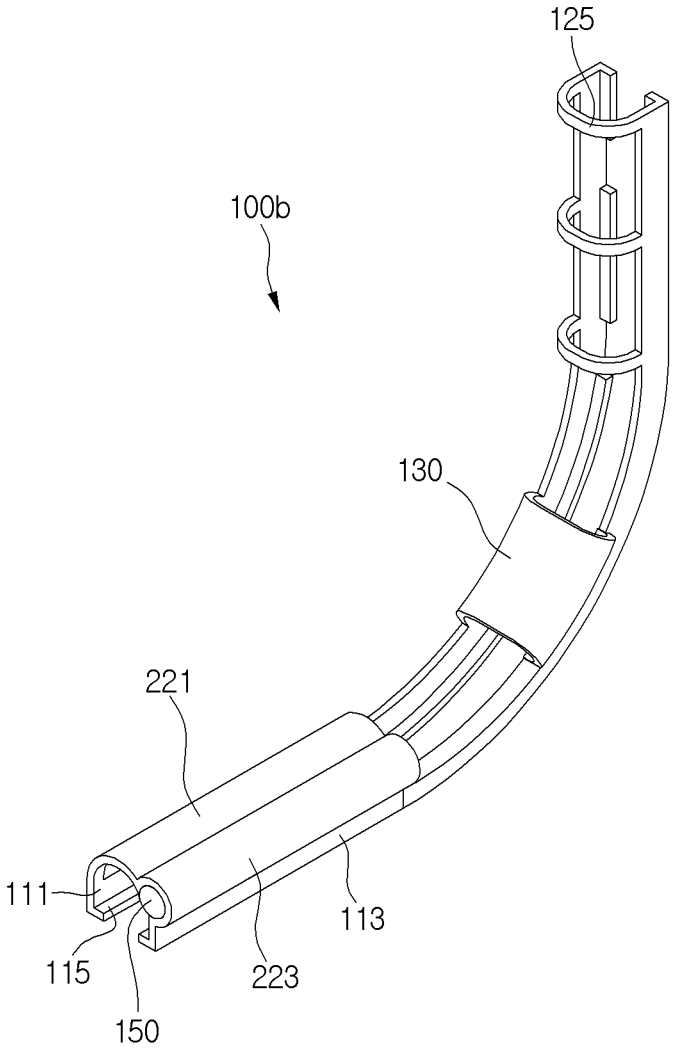
FIG. 7 is a perspective view of a sensor holder according to still another embodiment.

FIG. 7 is a perspective view of a sensor holder according to another embodiment. Referring to FIG. 7, a sensor holder 100*b* according to this embodiment may include first frame 111, second frame 113, support protrusion(s) 115, and reinforcing rib 130, as discussed above with respect to previous embodiments.

The sensor holder 100*b* may further include a tube shield 221 disposed to surround at least a portion of guide tube 80 and a sensor shield 223 that extends from the tube shield 221 to surround at least a portion of temperature sensor 150. In FIG. 7, the temperature sensor 150 may be disposed inside the sensor shield 223.

The tube shield 221 and the sensor shield 223 may shield an area (hereinafter, referred to as a contact area) of the guide tube 80 and the temperature sensor 150. Thus, it may prevent air flowing around heat exchanger 50 from acting on the contact area.

That is, the tube shield 221 and the sensor shield 223 may prevent surrounding air of the heat exchanger 50 from flowing toward the contact area. For example, outer surfaces of the tube shield 221 and the sensor shield 223 may have curved shapes that surround the guide tube 80 and the temperature sensor 150, respectively.

Figure 8:
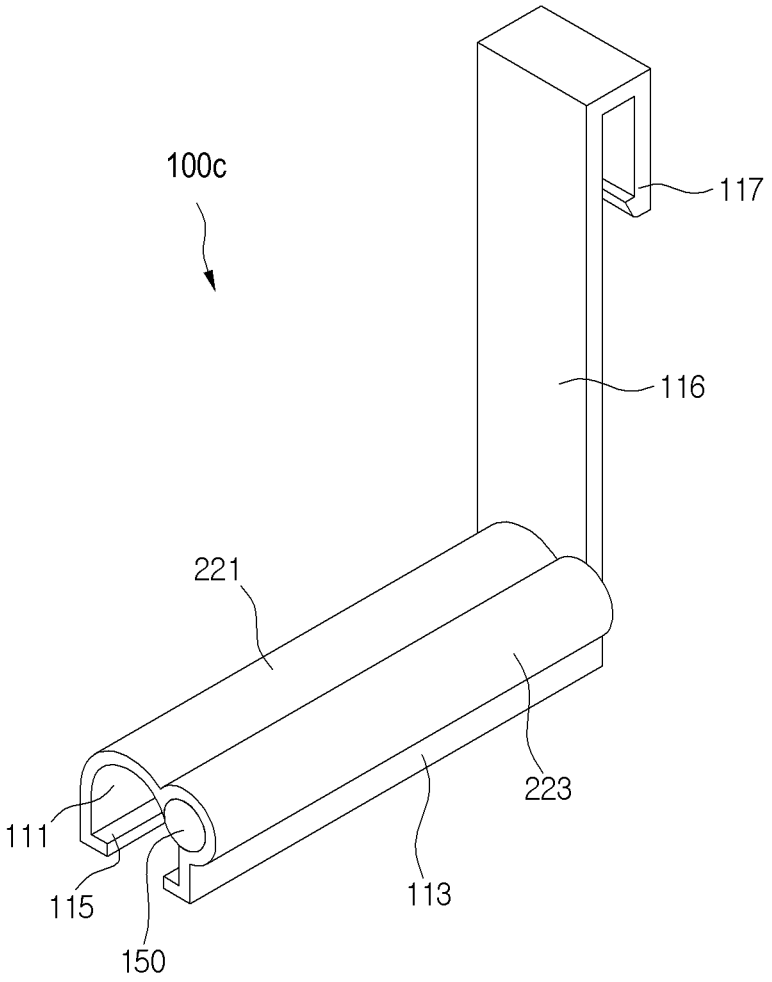
FIG. 8 is a perspective view of a sensor holder according to still another embodiment.

FIG. 8 is a perspective view of a sensor holder according to another embodiment. Referring to FIG. 8, a sensor holder 100*c* according to this embodiment may include first frame 111, second frame 113, and support protrusion(s) 115, as discussed above with respect to previous embodiments. The holder 100*c* may also include tube shield 221 and sensor shield 223, as discussed above with respect to previous embodiments.

The sensor holder 100*c* according to this embodiment may be coupled to guide tube 80 having a linear shape. A temperature sensor 150 may be disposed to contact an outside of the linear guide tube 80.

The tube shield 221 and the sensor shield 223 may shield the outside of an area (hereinafter, referred to as a contact area) of the guide tube 80 and the temperature sensor 150. In detail, the tube shield 221 may be disposed to surround at least a portion of the guide tube 80 to prevent surrounding air of heat exchanger 50 from flowing toward the guide tube 80 and the temperature sensor 150. Also, the sensor shield 223 may be disposed to surround at least a portion of the temperature sensor 150 to prevent surrounding air of the heat exchanger 50 from flowing toward the guide tube 80 and the temperature sensor 150.

The sensor holder 100*c* according to this embodiment may further include support bracket 116 and hook 117, which may respectively extend from the first and second frames 111 and 113 to fix the holder 100*c* to a side of the heat exchanger 50. Descriptions of the support bracket 116 and the hook 117 are the same as those discussed above with respect to the embodiment of FIG. 6.

Figure 9:
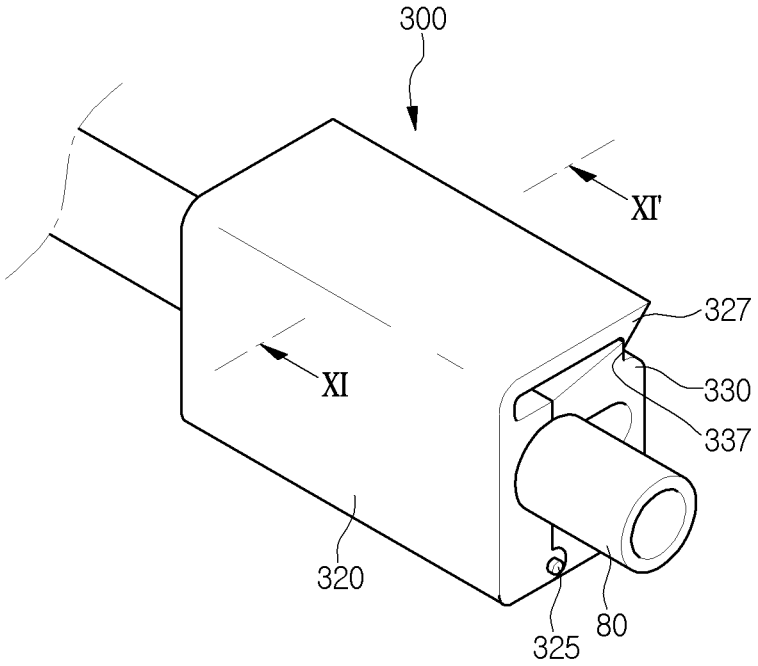
FIGS. 9 and 10 are perspective views of a sensor holder according to still another embodiment.
Figure 10:
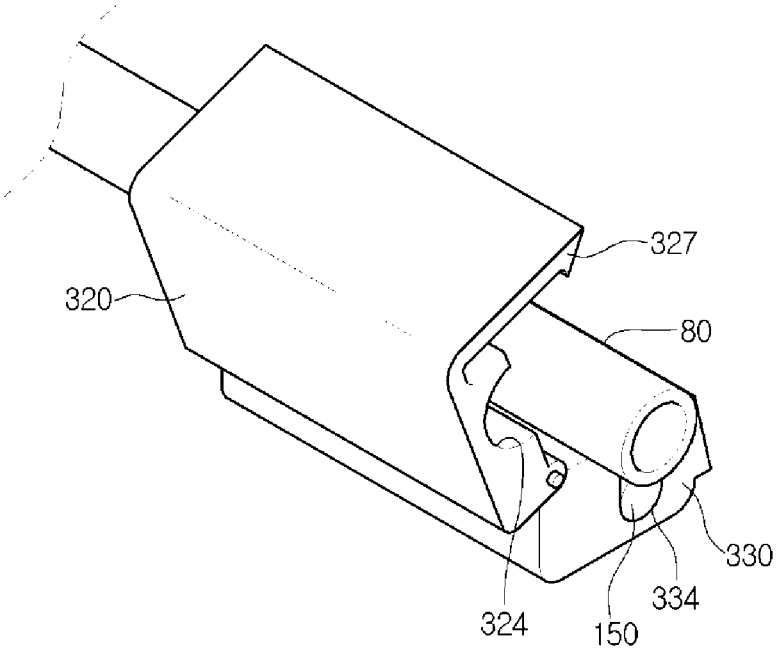
Figure 11:
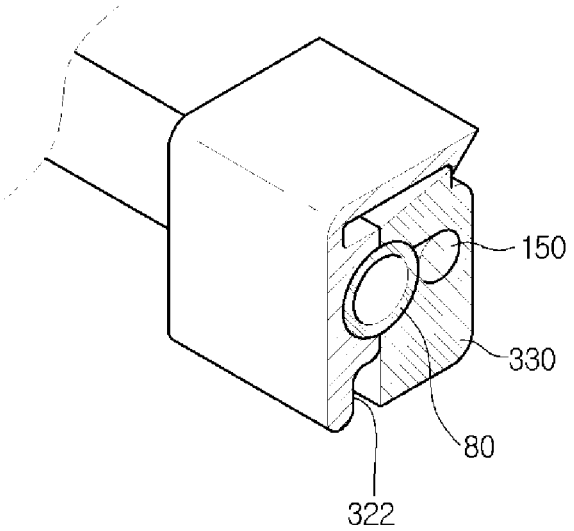
FIG. 11 is a cross-sectional view taken along line XI-XI' of FIG. 9.

FIGS. 9 and 10 are perspective views of a sensor holder according to another embodiment. FIG. 11 is a cross-sectional view taken along line XI-XI' of FIG. 9.

Referring to FIGS. 9 to 11, a sensor holder 300 according to this embodiment may include a plurality of supports or holders 320 and 330 that support guide tube 80 and temperature sensor 150 in a state in which the sensor holder 300 is in contact with the guide tube 80 and the temperature sensor 150. The plurality of supports 320 and 330 may include a tube support or first support 320 that surrounds at least a portion of the guide tube 80 and a sensor support or second support 330 that surrounds at least a portion of the temperature sensor 150.

The tube support 320 may be rotatably coupled to the sensor support 330. The sensor holder 300 may include a hinge shaft 325 coupled to the tube support 320 to provide a rotational center of the tube support 320. The tube support 320 may rotate with respect to the hinge shaft 325.

The tube support 320 may have an interference prevention groove 322 that guides the tube support 320 so that the tube support 320 rotates without interfering with the sensor support 330. At least a portion of the tube support 320 may be recessed to form the interference prevention groove 322.

A first installation groove or recess 324, in which at least a portion of the guide tube 80 may be seated, may be defined in the tube support 320. Also, a second installation groove or recess 334, in which at least a portion of the temperature sensor 150 may be seated, may be defined in the sensor support 320.

As illustrated in FIG. 9, when the tube support 320 and the sensor support 330 are closed, the guide tube 80 and the temperature sensor 150 may contact each other in a state in which the guide tube 80 and the temperature sensor 150 are respectively supported by the first and second installation grooves 324 and 334.

The sensor holder 300 may further include a hook 327 provided on the tube support 320 and a hook coupling portion 337 provided on the sensor support 330 to hook the tube support 320 and the sensor support 330 when the tube support 320 and the sensor support 330 are closed (see FIG. 9). On the other hand, as illustrated in FIG. 10, in the state in which the tube support 320 rotates, the hook 327 may be separated from the hook coupling portion 337, and the guide tube 80 and the temperature sensor 150 may be respectively separated from the tube support 320 and the sensor support 330.

Thus, as the plurality of supports may be rotatably coupled to each other, and the installation groove defined in each of the supports may receive the guide tube and the temperature sensor, respectively, seated therein, the guide tube and the temperature sensor may be effectively fixed in the state in which the guide tube and the temperature sensor contact each other.

For convenience of description, the above-described tube rib 121, tube shield 221, and tube support 320 may be collectively referred to as a "tube supporter", and the above-described sensor rib 123, sensor shield 223, and sensor support 330 may be collectively referred to as a "sensor supporter".

Figure 12:
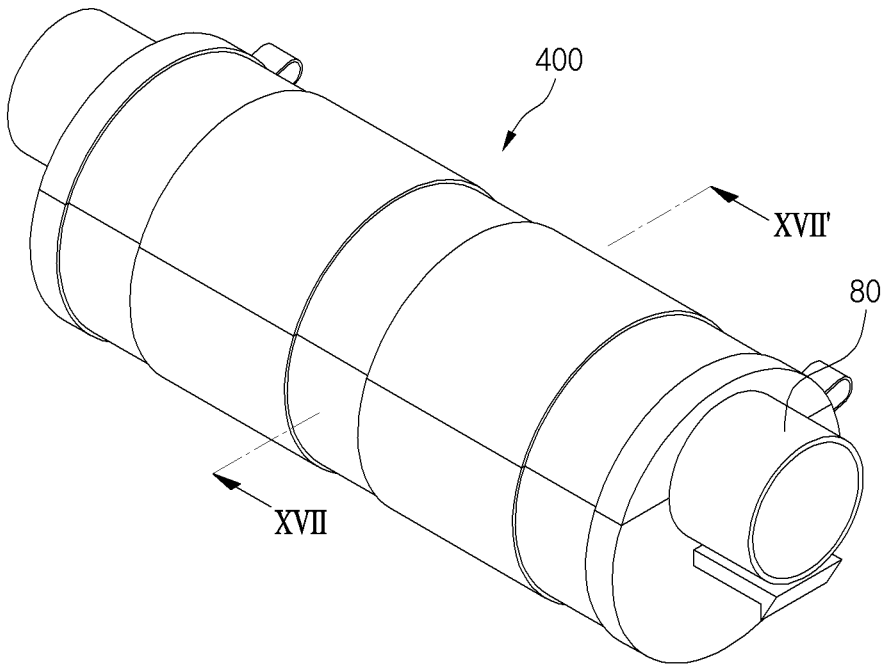
FIG. 12 is a view illustrating a state in which a sensor holder is coupled to a refrigerant tube according to another embodiment.
Figure 13:
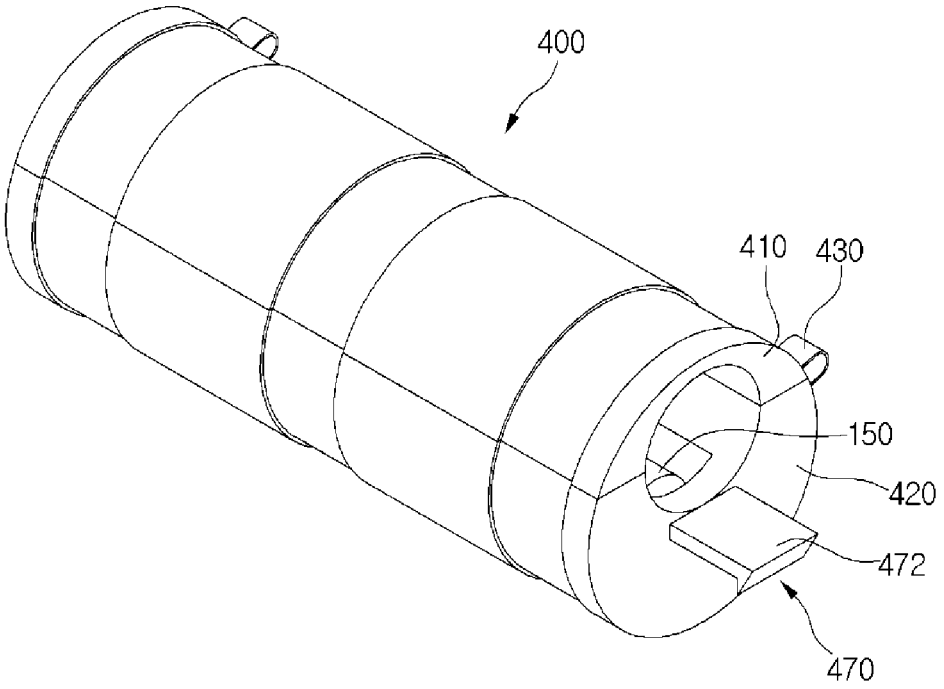
FIG. 13 is a perspective view of the sensor holder of FIG. 12.
Figure 14:
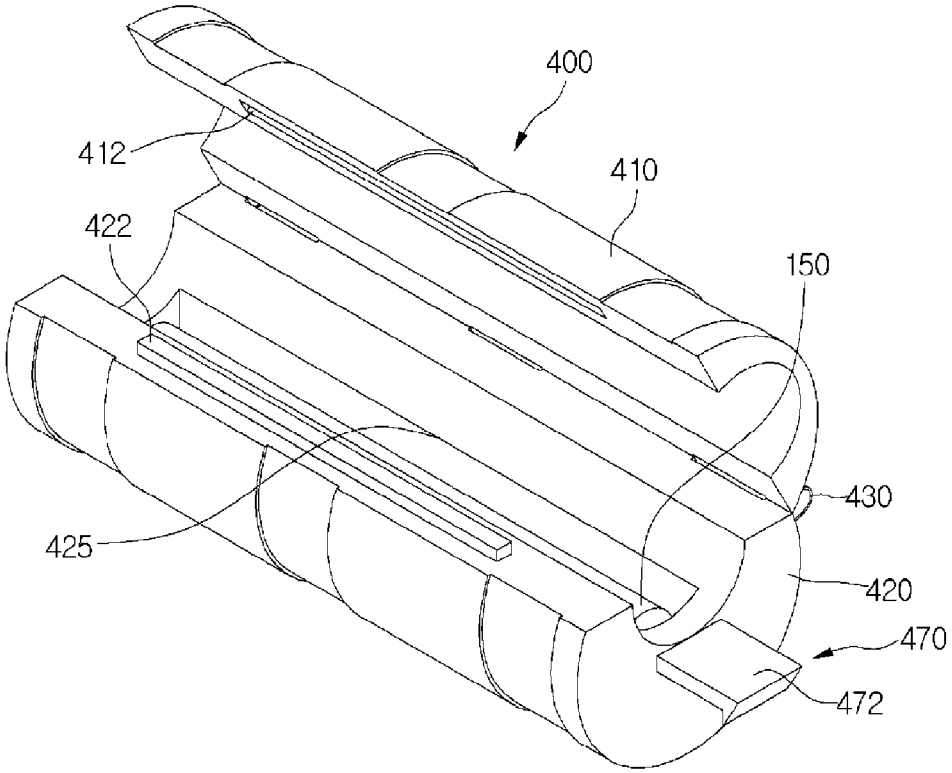
FIG. 14 is a view illustrating a state in which the sensor holder of FIG. 12 is open.
Figure 15:
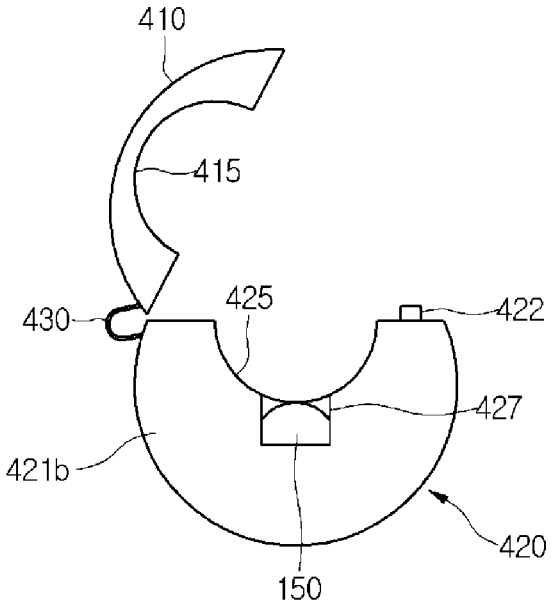
FIGS. 15 and 16 are views of a front and a rear of the sensor holder of FIG. 12 in a state in which the sensor holder is open.
Figure 16:
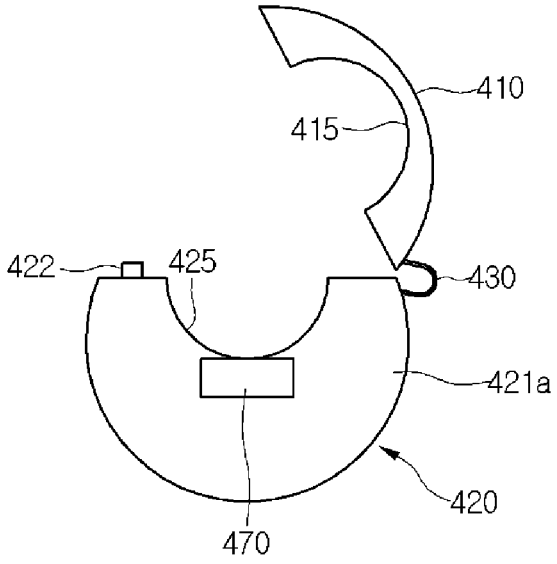
Figure 17:
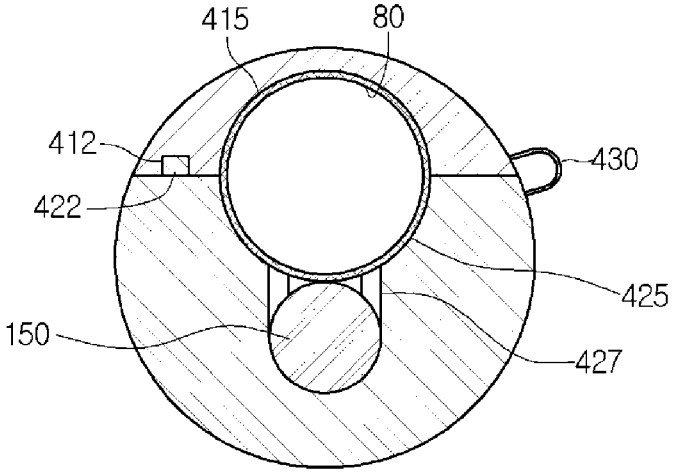
FIG. 17 is a cross-sectional view taken along line XVII-XVII' of FIG. 12.

FIG. 12 is a view illustrating a state in which a sensor holder is coupled to a refrigerant tube according to another embodiment. FIG. 13 is a perspective view of the sensor holder of FIG. 12. FIG. 14 is a view illustrating a state in which the sensor holder of FIG. 12 is open. FIGS. 15 and 16 are views of a front and a rear of the sensor holder of FIG. 12 in a state in which the second holder is open. FIG. 17 is a cross-sectional view taken along line XVII-XVII' of FIG. 12.

Referring to FIGS. 12 to 17, heat exchanger assembly 25 according to this embodiment may include a guide tube 80 to guide a flow of a refrigerant and a temperature sensor 150 disposed on or at a side of the guide tube 80. The heat exchanger assembly 25 according to this embodiment may further include a sensor holder 400 coupled to the guide tube 80 and the temperature sensor 150 to maintain a state in which the guide tube 80 is in contact with the temperature sensor 150.

The sensor holder 400 may include a first holder 410 coupled to a first side of the guide tube 80, a second holder 420 coupled to a second side of the guide tube 80, and a hinge 430 rotatably coupling the first holder 410 to the second holder 420. A space (a first space) in which at least a portion of the guide tube 80 may be accommodated, and a space (a second space) in which the temperature sensor 150 may be accommodated may be defined in the sensor holder 400. The sensor holder 400 may have an approximately hollow cylindrical shape to support the guide tube 80 and the temperature sensor 150. In detail, in a state in which the guide tube 80 and the temperature sensor 150 are installed inside the sensor holder 400, the first and second holders 410 and 420 may be disposed to surround at least a portion of the guide tube 80.

A first recess 415, which may correspond to an exterior (cylindrical shape) of the guide tube 80, may be defined in the first holder 410. The first recess 415 may be defined in an inner circumferential surface of the first holder 410. Also, in a state in which the first holder 410 covers a first side of the guide tube 80, the first recess 415 may support an outer circumferential surface of the guide tube 80. On the other hand, the guide tube 80 may be seated in the first recess 415.

A second recess 425, which may correspond to the exterior (cylindrical shape) of the guide tube 80, may be defined in the second holder 420. The second recess 425 may be defined in an inner circumferential surface of the second holder 420. Also, in a state in which the second holder 420 covers a second side of the guide tube 80, the second recess 425 may support the outer circumferential surface of the guide tube 80. On the other hand, the guide tube 80 may be seated in the second recess 425.

A sensor recess 427, in which the temperature sensor 150 may be accommodated, may be defined in the second holder 420. The sensor recess 427 may be recessed from the inner circumferential surface of the second holder 420. That is, the sensor recess 427 may be recessed from the second recess 425. Also, the temperature sensor 150 may contact the guide tube 80 seated in the second recess 425 in the state in which the temperature sensor 150 is seated in the sensor recess 127.

The sensor recess 427 may extend to a rear surface 421*b* of the second holder 420. A wire connected to the temperature sensor 150 may pass through the rear surface 421*b* of the second holder 420 via the second recess 427 to extend outside of the holder 400.

A hook 470 may be disposed on a front surface 421*a* of the second holder 420. The front surface 421*a* may be a first surface of the second holder 420, and the rear surface 421*b* may be a second surface of the second holder 420. The first surface may be a surface opposite to the second surface.

The hook 470 may allow the holder 400 to be hooked on an inner wall of a storage compartment of the refrigerator 10. An end of the hook 470 may have a hook shape. For example, the hook 470 may be hooked on a hook plate (not shown). The hook plate may be disposed on inner case 11*a* of refrigerator body 11 (FIG. 1).

Due to the hook, the holder 400 may be firmly fixed to a side of heat exchanger 50. Thus, contact between the guide tube 80 and the temperature sensor 150 may be maintained.

The hook 470 may include a support 472 that supports the guide tube 80. The support 472 may protrude outward from the front surface 421*a* of the second holder 420. The guide tube 80 may be supported by the support 472 to prevent an outer circumferential surface of the guide tube 80 from interfering with the first recess 415 or the second recess 425, thereby preventing the sensor holder 400 from being damaged.

The sensor holder 400 may include coupling devices 412 and 422 to maintain a coupled state between the first holder 410 and the second holder 420. The coupling devices 412 and 422 may include, for example, a groove 412 defined in the first holder 410 and a protrusion 422 provided on the second holder 120 and inserted into the groove 412. The protrusion 422 may be, for example, a "coupling rib" that protrudes from a surface of the second holder 420. Alternatively, the protrusion may be provided on the first holder 410, and the groove may be defined in the second holder 420.

The first holder 410, the second holder 420, and the hinge 430 may be integrated with each other. That is, the first and second holders 410 and 420 and the hinge 430 may be provided as a single body.

The hinge 430 may extend outward from an outer surface of the first holder 410 and then be bent or curved toward an outer surface of the second holder 420. The hinge 430 may be a member having a predetermined elastic force; for example, the hinge may be formed of plastic.

Referring to FIG. 17, in a state in which the guide tube 80 and the temperature sensor 150 are installed inside the sensor holder 400, the outer circumferential surface of the guide tube 80 may be supported by the first recess 415 of the first holder 410 and the second recess 425 of the second holder 420. Also, in the state in which the temperature sensor 150 is accommodated in the sensor recess 427, a portion of the temperature sensor 150 may be exposed to contact the outer circumferential surface of the guide tube 80. As described above, as the temperature sensor 150 directly contacts the guide tube 80, the guide tube 80 may be easily detected in temperature.

Figure 18:
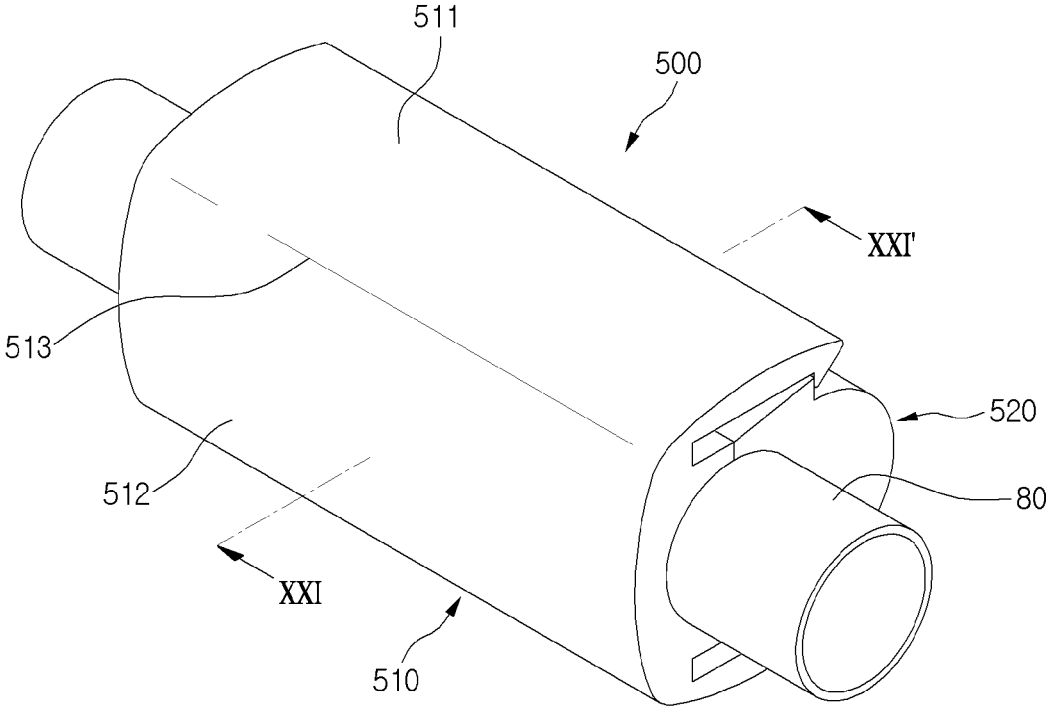
FIG. 18 is a view illustrating a state in which a sensor holder is coupled to a refrigerant tube of a heat exchanger according to yet another embodiment.
Figure 19:
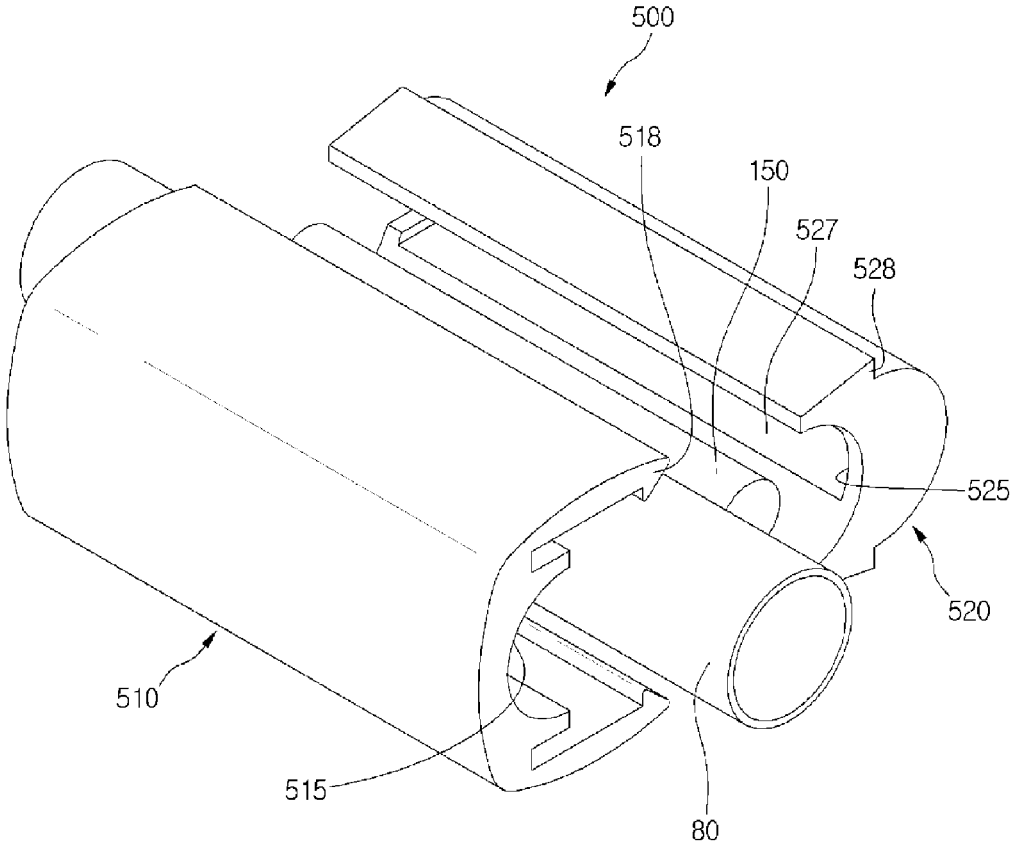
FIG. 19 is an exploded perspective view of the refrigerant tube and the sensor holder of FIG. 18.
Figure 20:
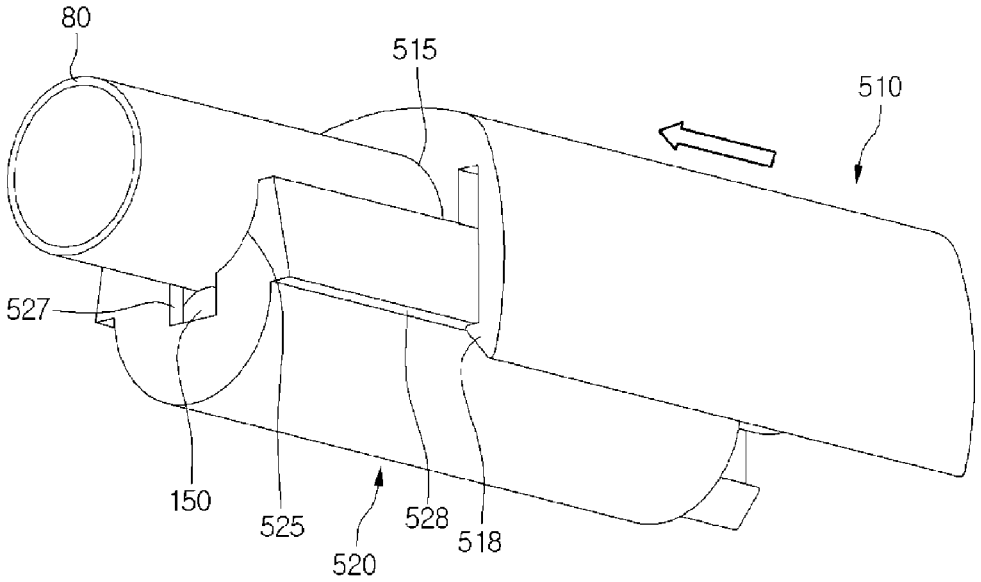
FIG. 20 is a view illustrating a state in which first and second holders of the sensor holder of FIG. 18 are coupled.
Figure 21:
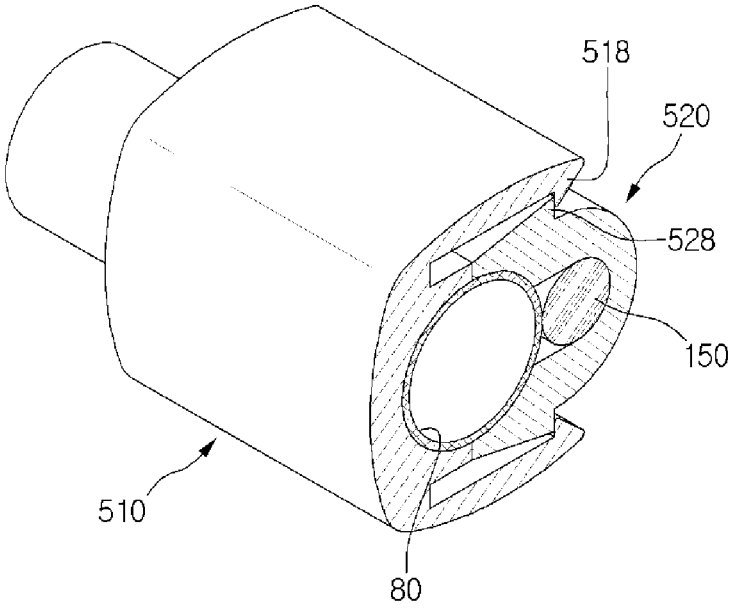
FIG. 21 is a cross-sectional view taken along line XXI-XXI' of FIG. 18.

FIG. 18 is a view illustrating a state in which a sensor holder is coupled to a refrigerant tube of a heat exchanger according to another embodiment. FIG. 19 is an exploded perspective view of the refrigerant tube and the sensor holder of FIG. 18. FIG. 20 is a view of illustrating a state in which first and second holders of the sensor holder of FIG. 18 are coupled. FIG. 21 is a cross-sectional view taken along line XXI-XXI' of FIG. 18.

Referring to FIGS. 18 and 21, a sensor holder 500 according to this embodiment may include a first holder 510 and a second holder 520, which may be separably coupled to each other. As described with respect to previous embodiments, the first holder 510 and the second holder 520 may support the guide tube 80 and the temperature sensor 150 so that the guide tube 80 and the temperature sensor 150 contact each other.

The first holder 510 may include a first recess 515 corresponding to an outer circumferential surface of the guide tube 80 and a hook 518 coupled to the second holder 520. The first recess 515 may define an inner surface of the first holder 510. The hook 518 may be disposed on each of both sides of the first recess 515 and be slidably coupled to the second holder 520.

The first holder 510 may include a top surface 511, a side surface 512, and a curved portion 513 that roundly extends from the top surface 511 to the side surface 512. Heat exchanger 50 may be frozen by defrost water therearound. As the curved portion 513 may be provided on the first holder 510, the defrost water may be discharged downward from the top surface 511 of the first holder 510 along the curved portion 513 to prevent the heat exchanger 50 from being frozen and improve defrosting reliability.

The second holder 520 may include a second recess 525 corresponding to the outer circumferential surface of the guide tube 80, and a hook coupling portion 528, which may be coupled to the hook 518 of the second holder 520. The second recess 525 may define an inner surface of the second holder 520. The hook coupling portion 528 may be disposed on an outer surface of the second holder 520.

The second holder 520 may further include a sensor recess 527 to accommodate the temperature sensor 150. The sensor recess 527 may be recessed from an inner surface of the second holder 520. The sensor recess 527 may be further recessed from the second recess 525. Also, the sensor recess 527 may extend to a rear surface of the second holder 520.

Referring to FIG. 20, in a state in which the temperature sensor 150 is accommodated in the sensor recess 527, and the guide tube 80 is installed in the second recess 525, the second holder 520 may be slidably coupled to the first holder 510. In detail, in the state in which the hook 518 of the first holder 510 is hooked on the hook coupling portion 528 of the second holder 520, the first holder 510 may slide in a direction in which the first holder 510 covers the guide tube 80. That is, the hook 518 of the first holder 510 may function as a "rail", and the hook coupling portion 528 of the second holder 520 may function as a "rail guide".

As described above, the sensor holder 500 may be easily coupled or separated by the slidable coupling method of the first and second holders 510 and 520. Also, as illustrated in FIG. 21, as the guide tube 80 and the temperature sensor 150 stably contact each other within the first and second holders 510 and 520, a temperature of the guide tube 80 may be easily detected.

Figure 22:
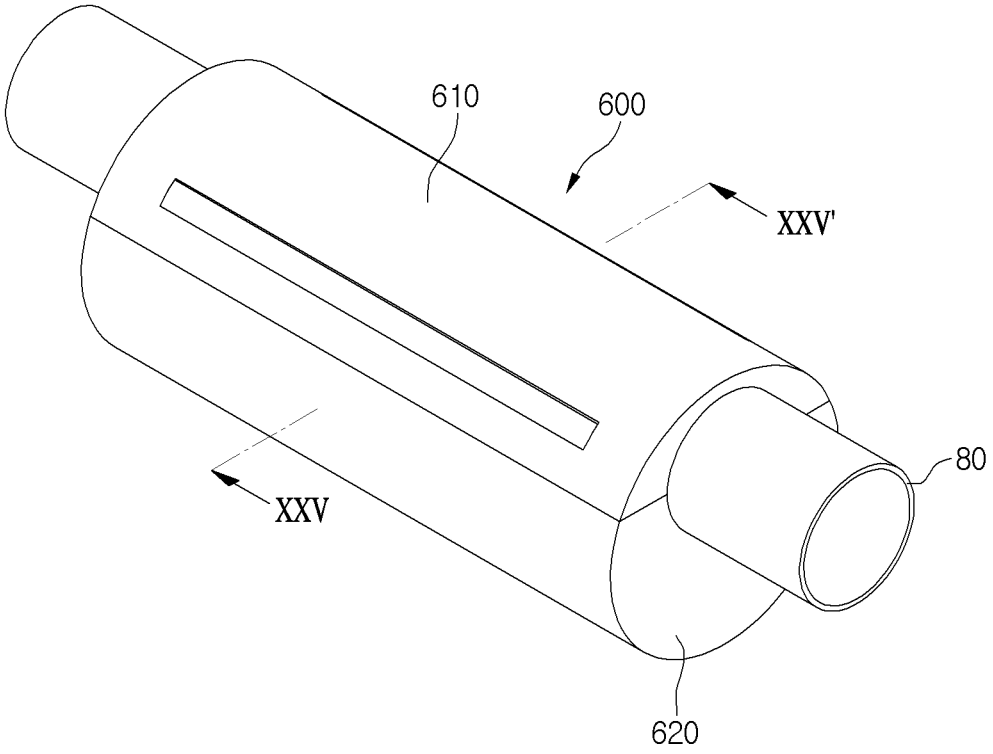
FIG. 22 is a view illustrating a state in which a sensor holder is coupled to a refrigerant tube according to yet another embodiment.
Figure 23:
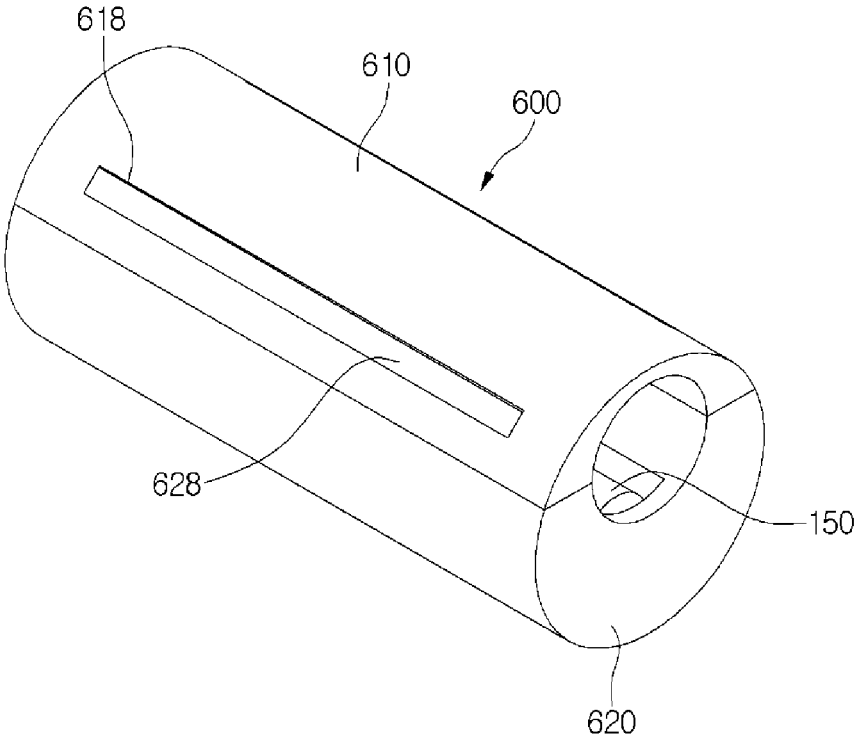
FIG. 23 is a perspective view of the refrigerator tube and the sensor holder of FIG. 22.
Figure 24:
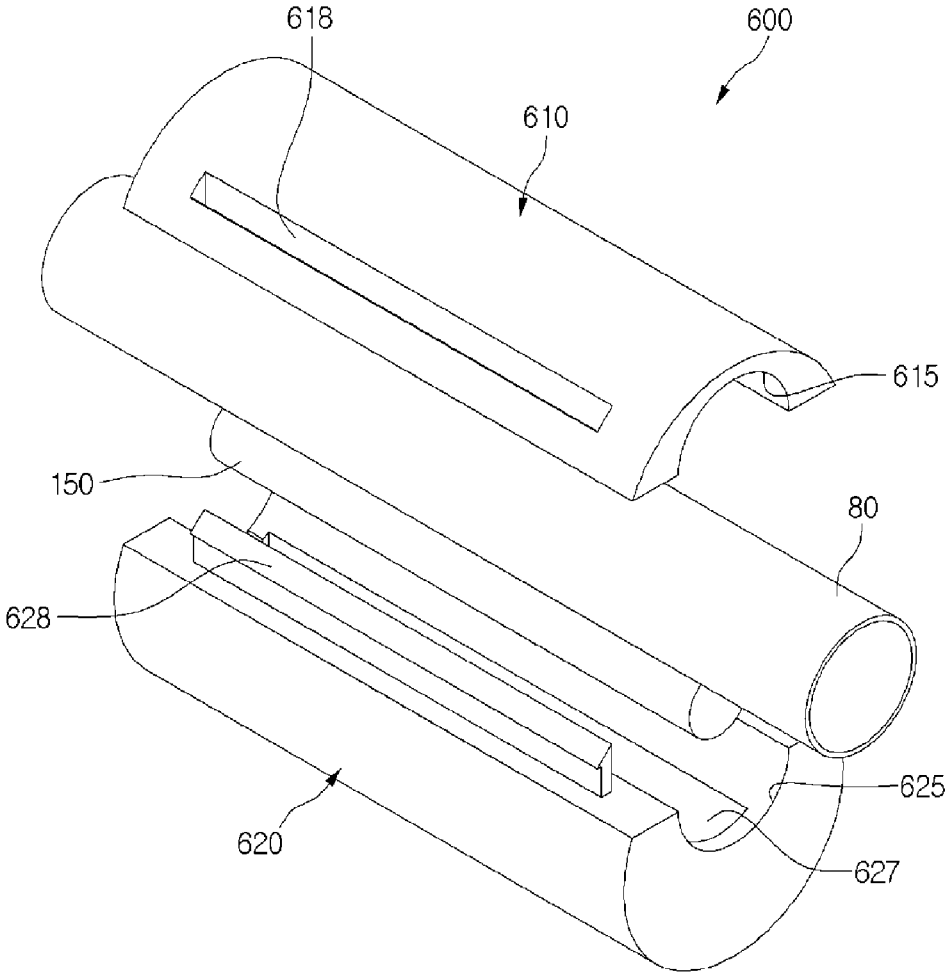
FIG. 24 is an exploded perspective view of the refrigerant tube and the sensor holder of FIG. 22.
Figure 25:
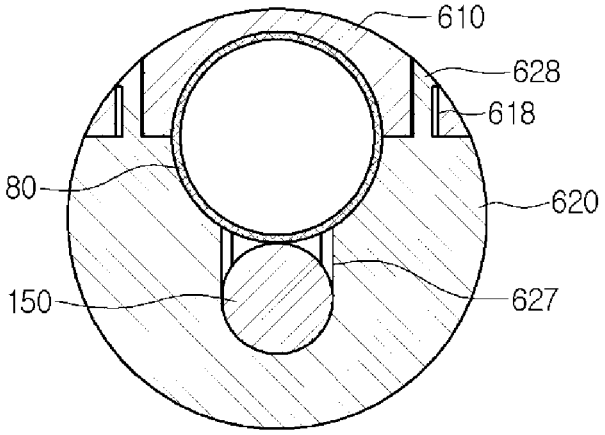
FIG. 25 is a cross-sectional view taken along line XXV-XXV' of FIG. 22.

FIG. 22 is a view illustrating a state in which a sensor holder is coupled to a refrigerant tube according to another embodiment. FIG. 23 is a perspective view of the sensor holder of FIG. 22. FIG. 24 is an exploded perspective view of the refrigerant tube and the sensor holder of FIG. 22. FIG. 25 is a cross-sectional view taken along line XXV-XXV' of FIG. 22.

Referring to FIGS. 22 and 25, a sensor holder 600 according to this embodiment may include a first holder 610 and a second holder 620, which may be separably coupled to each other. As with the previously-described embodiments, the first holder 610 and the second holder 620 may support the guide tube 80 and the temperature sensor 150 so that the guide tube 80 and the temperature sensor 150 contact each other.

The first holder 610 may include a first recess 615 corresponding to an outer circumferential surface of the guide tube 80 and a hook coupling portion 618 to be coupled to the hook 628 of the second holder 620. The first recess 615 may define an inner surface of the first holder 610. Also, the hook coupling portion 618 may be disposed on each of both sides of the first holder 610 and vertically pass through the first holder 610. That is, the hook coupling portion 618 may be a "through hole".

The second holder 620 may include a second recess 625 corresponding to the outer circumferential surface of the guide tube 80, and a hook 628 coupled to the hook coupling portion 618 of the first holder 610. Although the hook coupling portion 618 is shown disposed on the first holder 610, and the hook 628 disposed on the second holder 620 in this embodiment, embodiments are not limited thereto. For example, the hook may be disposed on the first holder, and the hook coupling portion may be disposed on the second holder. The second recess 625 may define an inner surface of the second holder 620. Also, the hook 628 may protrude from a surface of the second holder 620. The hook 628 may be disposed on each of both sides of the second holder 620.

The hook 628 may extend into the hook coupling portion 618 and then be hooked on an end of the hook coupling portion 618. That is, in a state in which the first and second holders 610 and 620 are coupled to each other, the hook 628 may extend into the hook coupling portion 618 without protruding outside of the holder 600. As a result, the hook 628 and the hook coupling portion 618 may be collectively referred to as an "inner hook device".

As described above, the inner hook device 618 and 628 may be provided to reduce the possibility of the introduction of remaining water into the coupled portion between the hook 628 and the hook coupling portion 618. If the remaining water expands in volume while being introduced into the coupled portion between the hook 628 and the hook coupling portion 618 and then cooled, the first and second holders may be relatively easily separated from each other. However, this embodiment may prevent the first and second holders from being easily separated from each other.

The second holder 620 may further include a sensor recess 627 to accommodate the temperature sensor 150. The sensor recess 627 may be recessed from an inner surface of the second holder 620. The sensor recess 627 may be recessed from the second recess 625. Also, the sensor recess 627 may extend up to a rear surface (see reference numeral 421*b* of FIG. 15) of the second holder 620.

Referring to FIG. 25, the guide tube 80 and the temperature sensor 150 may be disposed to contact each other within the first and second holders 610 and 620. Also, the hook 628 may extend into the hook coupling portion 618, and thus, be hooked with the hook coupling portion 618 without protruding from an outer surface of the holder 600, thereby improving reliability of the holder.

Figure 26:
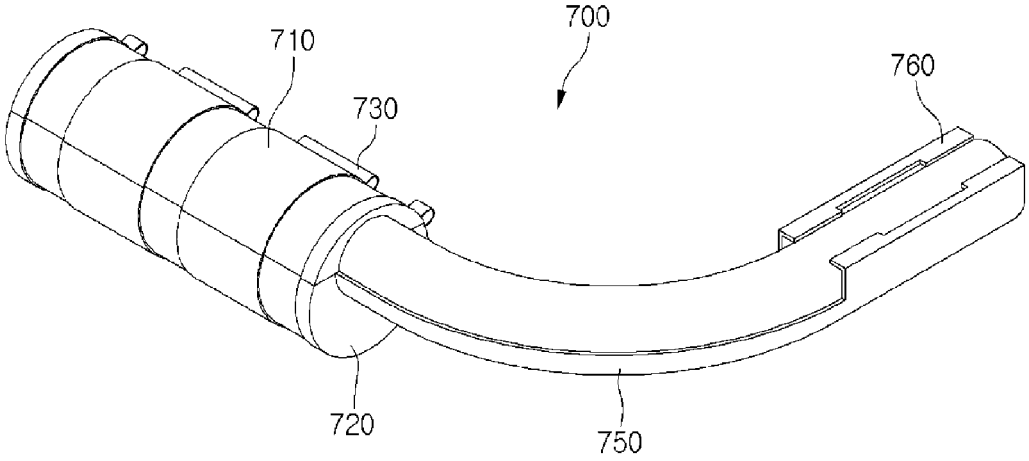
FIG. 26 is a view illustrating a state in which a sensor holder is coupled to a refrigerant tube according to yet another embodiment.
Figure 27:
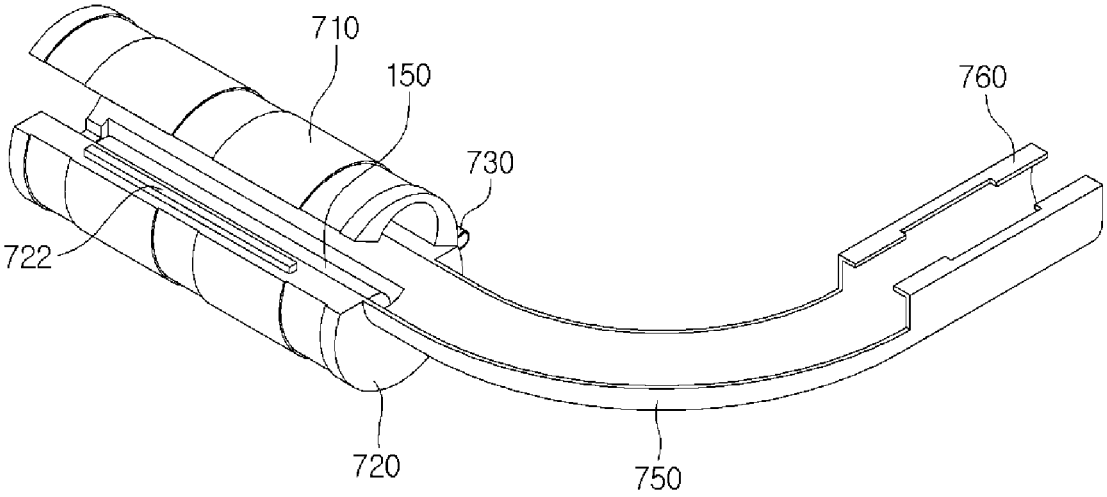
FIG. 27 is a view illustrating a state in which the sensor holder of FIG. 26 is open.
Figure 28:
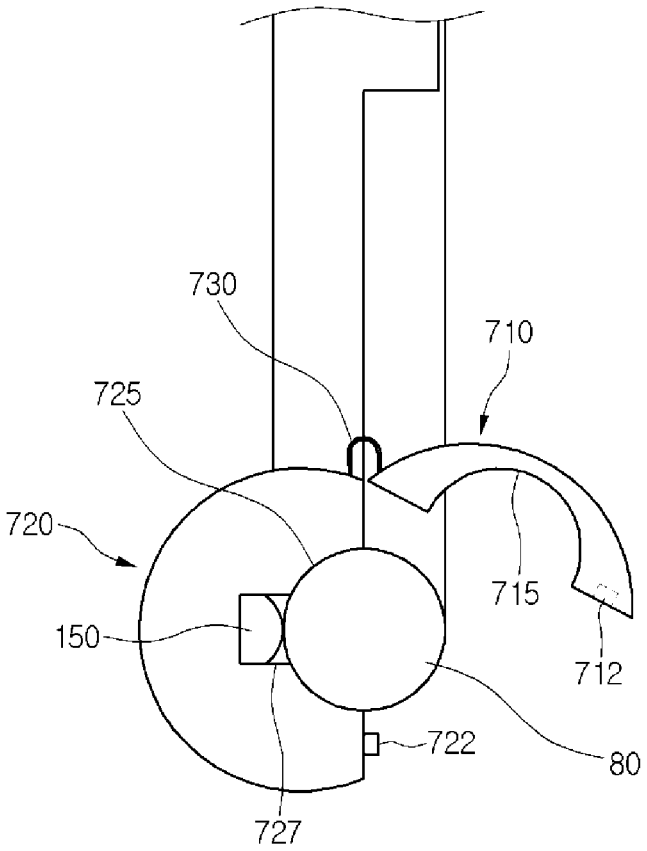
FIG. 28 is a view of the refrigerant tube and the sensor holder of FIG. 26.

FIG. 26 is a view illustrating a state in which a sensor holder is coupled to a refrigerant tube according to another embodiment. FIG. 27 is a view illustrating a state in which the sensor holder of FIG. 26 is open. FIG. 28 is a view of the refrigerant tube and the sensor holder of FIG. 26.

Referring to FIGS. 26 to 28, a sensor holder 700 according to this embodiment may include a first holder 710, a second holder 720, and a hinge 730. The first holder 710 may include a first recess 715 and a groove 712. The second holder 720 may include a second recess 725, a sensor recess 727, and a coupling portion or protrusion 722 to be coupled to the groove 712. As the first and second holders 710 and 720 and the hinge 730 are similar to those described according to previous embodiments, their detailed descriptions has been omitted.

The sensor holder 700 may further include a frame 750 that extends outward from the first and second holders 710 and 720 to support the guide tube 80, and a separation prevention rib 760 coupled to the frame 750 to prevent the guide tube 80 from being separated from the frame 750. The frame 750 may be configured to support rounded guide tube 80. Thus, the frame 750 may be rounded to correspond to the shape of the guide tube 80. Also, the frame 750 may be disposed to surround a lower portion of the guide tube 80.

The separation prevention rib 760 may be spaced apart from the first and second holders 710 and 720 and coupled to the frame 750. Further, the separation prevention rib 760 may extend from an upper end of the frame 750 to surround at least a portion of an upper portion of the guide tube 80. That is, the frame 750 and the separation prevention rib 760 may surround at least a portion of the guide tube 80 to prevent the guide tube 80 from being separated from the frame 750.

Figure 29:
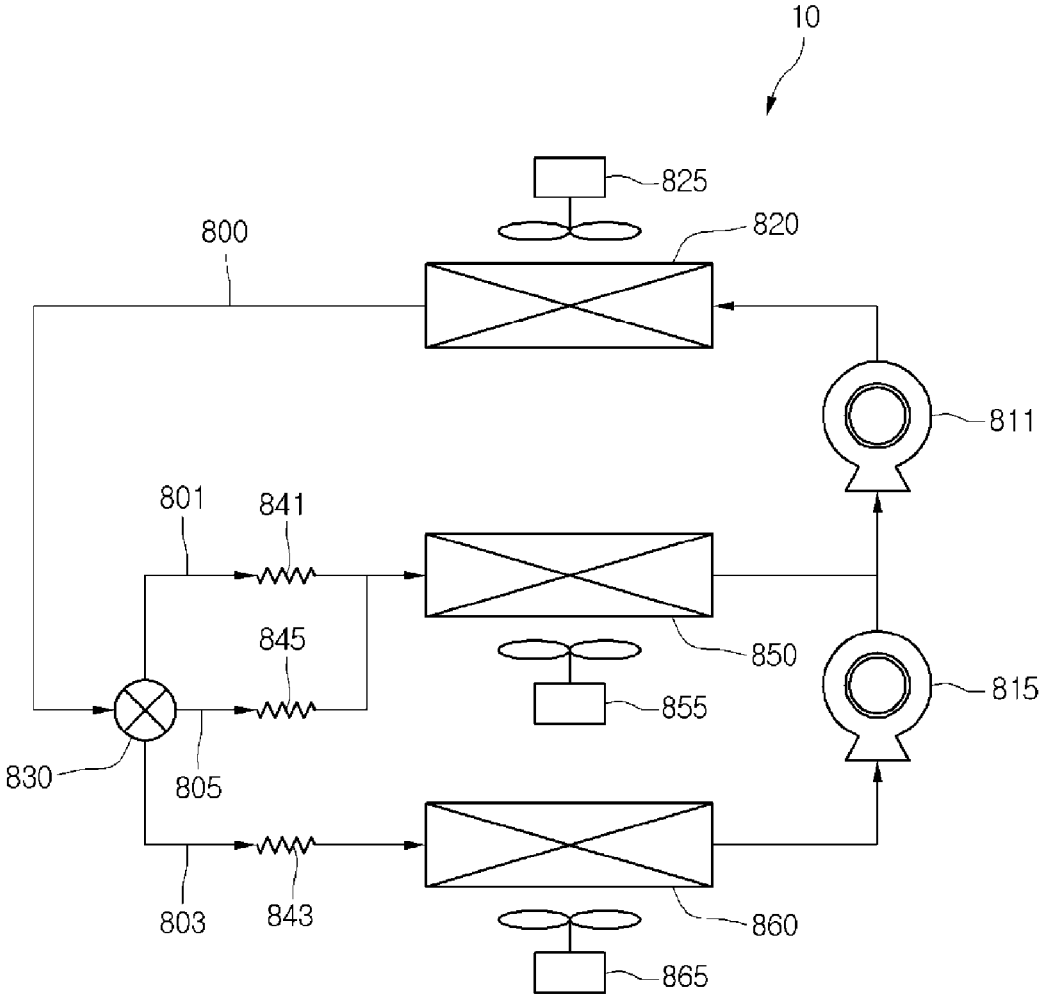
FIG. 29 is a cycle view illustrating a refrigerator according to an embodiment.
Figure 30:
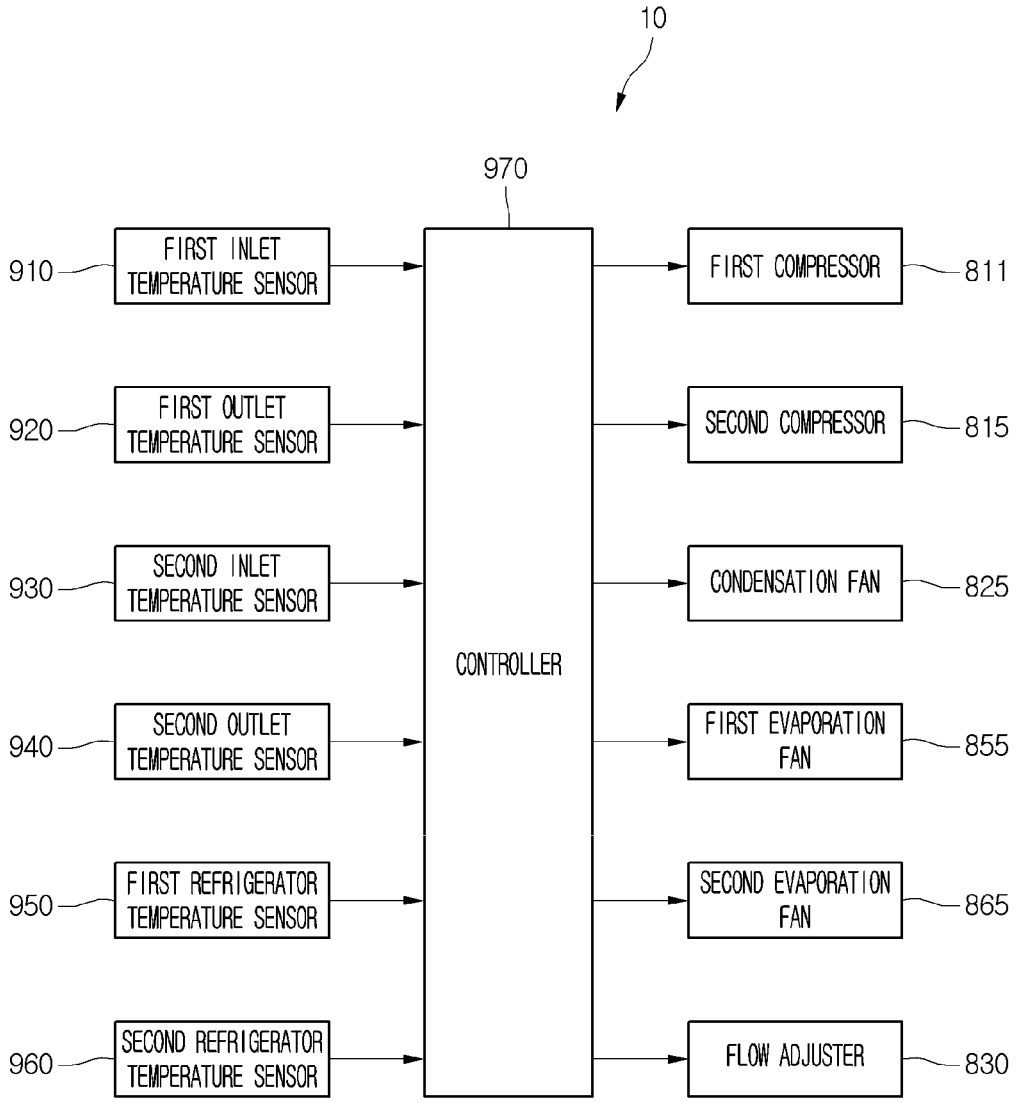
FIG. 30 is a block diagram of the refrigerator of FIG. 29.

FIG. 29 is a cycle view illustrating a refrigerator according to an embodiment. FIG. 30 is a block diagram of the refrigerator of FIG. 29.

Referring to FIGS. 29 to 30, refrigerator 10 according to this embodiment may include a plurality of devices to drive a refrigeration cycle. In detail, the refrigerator 10 may include a plurality of compressors 811 and 815 to compress a refrigerant, a condenser 820 to condense the refrigerant compressed in the plurality of compressors 811 and 815, a plurality of expansion devices 841, 843, and 845 to decompress the refrigerant condensed in the condenser 820, and a plurality of evaporators 850 and 860 to evaporate the refrigerant decompressed in the plurality of expansion devices 841, 843, and 845. The refrigerator 10 may further include a refrigerant tube 800 that connects the plurality of compressors 811 and 815, the condenser 820, the expansion devices 841, 843, and 845, and the evaporators 850 and 860 to each other to guide a flow of the refrigerant.

The plurality of compressors 811 and 815 may include a first compressor 811 and a second compressor 815. The second compressor 815 may be disposed at a low-pressure side and the first compressor 811 may further compress the refrigerant compressed in the second compressor 815.

The first compressor 811 and the second compressor 815 may be connected to each other in series. That is, an outlet-side refrigerant tube of the second compressor 815 may be connected to an inlet-side of the first compressor 811.

The plurality of evaporators 850 and 860 may include a first evaporator 850 to generate cold air to be supplied into one storage compartment of a refrigerating compartment and a freezing compartment, and a second evaporator 860 to generate cold air to be supplied into the other storage compartment.

For example, the first evaporator 850 may generate cold air to be supplied into the refrigerating compartment and be disposed on or at a side of the refrigerating compartment. The second evaporator 860 may generate cold air to be supplied into the freezing compartment and be disposed on or at a side of the freezing compartment.

The cold air to be supplied into the freezing compartment may have a temperature less than a temperature of the cold air to be supplied into the refrigerating compartment. Thus, a refrigerant evaporation pressure of the second evaporator 860 may be less than a refrigerant evaporation pressure of the first evaporator 850.

An outlet-side refrigerant tube 800 of the second evaporator 860 may extend to an inlet-side of the second compressor 815. Thus, the refrigerant passing through the second evaporator 860 may be introduced into the second compressor 815.

The outlet-side refrigerant tube 800 of the first evaporator 850 may be connected to the outlet-side refrigerant tube of the second compressor 815. Thus, the refrigerant passing through the first evaporator 850 may be mixed with the refrigerant compressed in the second compressor 815, and then the mixture may be suctioned into the first compressor 811.

The plurality of expansion devices 841, 843, and 845 may include first, second, and third expansion device 841, 843, and 845. The first and third expansion devices 841, 845 may expand the refrigerant to be introduced into the first evaporator 850, and the second expansion device 843 may expand the refrigerant to be introduced into the second evaporator 860. Each of the first to third expansion devices 841, 843, and 845 may include a capillary tube. The capillary tube of the second expansion device 843 may have a diameter less than a diameter of the capillary tube of each of the first and third expansion devices 841 and 845, so that a refrigerant evaporation pressure of the second evaporator 860 is less than a refrigerant evaporation pressure of the first evaporator 850.

A plurality of refrigerant passages 801 and 805 to guide the introduction of the refrigerant into the first evaporator 850 may be defined in the inlet-side of the first evaporator 850. The plurality of refrigerant passages 801 and 805 may include a first refrigerant passage 801, in which the first expansion device 841 may be disposed, and a third refrigerant passage 805, in which the third expansion device 845 may be disposed. The first and third refrigerant passages 801 and 805 may be collectively referred to as a "first evaporation passage" in that the first and third refrigerant passages 801 and 805 guide the introduction of the refrigerant into the first evaporator 850. The refrigerants flowing into the first and third refrigerant passages 801 and 805 may be mixed with each other and then be introduced into the first evaporator 850.

Also, a refrigerant passage 803 to guide the introduction of the refrigerant into the second evaporator 860 may be defined in the inlet-side of the second evaporator 860. The second expansion device 843 may be disposed in the refrigerant passage 803. The second refrigerant passage 803 may be referred to as a "second evaporation passage" in that the second refrigerant passage 803 may guide the introduction of the refrigerant into the second evaporator 860. The first to third refrigerant passages 801, 803, and 805 may be collectively referred to as a "branch passage" that is branched from the refrigerant tube 800.

The refrigerator 10 may further include a flow adjuster 830 that branches and introduces the refrigerant into the first to third refrigerant passages 801, 803, and 805. The flow adjuster 830 may allow the first and second evaporators 850 and 860 to be operated at the same time, that is, the flow adjuster 830 may adjust a flow of the refrigerant so that the refrigerant is introduced into the first and second evaporators 850, 860 at the same time.

The flow adjuster 830 may include a four-way valve having one inflow, through which the refrigerant may be introduced, and three discharges, through which the refrigerant may be discharged. The three discharges of the flow adjuster 830 may be connected to the first to third refrigerant passages 801, 803, and 805, respectively. Thus, the refrigerant passing through the flow adjuster 830 may be branched and discharged into the first to third refrigerant passages 801, 803, and 805. The discharges connected to the first to third refrigerant passages 801, 803, and 805 may be referred to as a "first discharge", a "second discharge", and a "third discharge" in order.

At least one discharge of the first to third discharges may be opened. When all of the first to third discharges are opened, the refrigerant may flow through the first to third refrigerant passages 801, 803, and 805. On the other hand, when the first and second discharges are opened, and the third discharge is closed, the refrigerant may flow through the first and second refrigerant passages 801 and 803.

As described above, a flow path of the refrigerant may vary according to the control of the flow adjuster 830. Also, the control of the flow adjuster 830 may be performed on the basis of whether the refrigerant within the first or second evaporator 850 or 860 is excessive or lacking.

For example, when the first and second evaporators 850 and 860 operate at the same time, if the refrigerant within the first evaporator 850 is relatively lacking, the flow adjuster 830 may be controlled so that the refrigerant flows into the first to third refrigerant passages 801, 803, and 805.

On the other hand, if the refrigerant within the second evaporator 860 is relatively lacking, the third refrigerant passage 805 may be closed, and the flow adjuster 830 may be controlled so that the refrigerant flows into the first and second refrigerant passages 801 and 803. That is, the plurality of flow passages 801 and 805 for refrigerant to be introduced into the first evaporator 850 may be provided, and the flow of the refrigerant may be selectively controlled through the plurality of flow passages 801 and 805 to adjust an amount of refrigerant to be introduced into the first or second evaporator 850 or 860.

As a larger amount of refrigerant may flow into the inlet-side of the first evaporator 850 than the inlet-side of the second evaporator 860, when all of the first to third refrigerant passages 801, 803, and 805 are opened, a larger amount of refrigerant may flow into the first evaporator 850 than the second evaporator 860. That is, a heat-exchange performance of the first evaporator 850 may be greater than a heat exchange performance of the second evaporator 860. Thus, when the first evaporator 850 corresponds to a refrigerating compartment-side evaporator, and the second evaporator 860 corresponds to a freezing compartment-side evaporator, a cooling load or capacity of the refrigerating compartment may be greater than a cooling load or capacity of the freezing compartment.

The refrigerator 10 may include blower fans 825, 855, and 865. The blower fans 825, 855, and 865 may include a condensation fan 825 provided at a side of the condenser 820, a first evaporation fan 855 provided at a side of the first evaporator 850, and a second evaporation fan 865 provided at a side of the second evaporator 860.

Heat-exchange performance of the first and second evaporators 850 and 860 may vary according to a rotation rate of each of the first evaporation fans 855 and 865. For example, if a large amount of refrigerant is required according to the operation of the evaporator 850, the first evaporation fan 855 may increase in rotation rate. Also, if cold air is sufficient, the first evaporation fan 855 may be reduced in rotation rate.

Referring to FIG. 30, the refrigerator 10 according to this embodiment may include a plurality of temperature sensors 910, 920, 930, and 940 that detect inlet or outlet temperatures of each of the first and second evaporators 850 and 860. The plurality of temperature sensors 910, 920, 930, and 940 may include a first inlet temperature sensor 910 to detect an inlet-side temperature of the first evaporator 850 and a first outlet temperature sensor 920 to detect an outlet-side temperature of the first evaporator 850. The plurality of temperature sensors 910, 920, 930, and 940 may further include a second inlet temperature sensor 930 to detect an inlet-side temperature of the second evaporator 860 and a second outlet temperature sensor 940 to detect an outlet-side temperature of the second evaporator 860.

The refrigerator 10 may further include a first refrigerator temperature sensor 950 to detect a temperature within the refrigerating compartment, and a second refrigerator temperature sensor 960 to detect a temperature within the freezing compartment. The refrigerator 10 may further include a controller 970 to control an operation of the flow adjuster 830 on the basis of the temperatures detected by the plurality of temperature sensors 910, 920, 930, and 940. To perform cooling operations of the refrigerating and freezing compartments at the same time, the controller 970 may control operations of the first and second compressors 811 and 815, the condensation fan 825, and the first and second evaporation fans 855 and 865.

Figure 31:
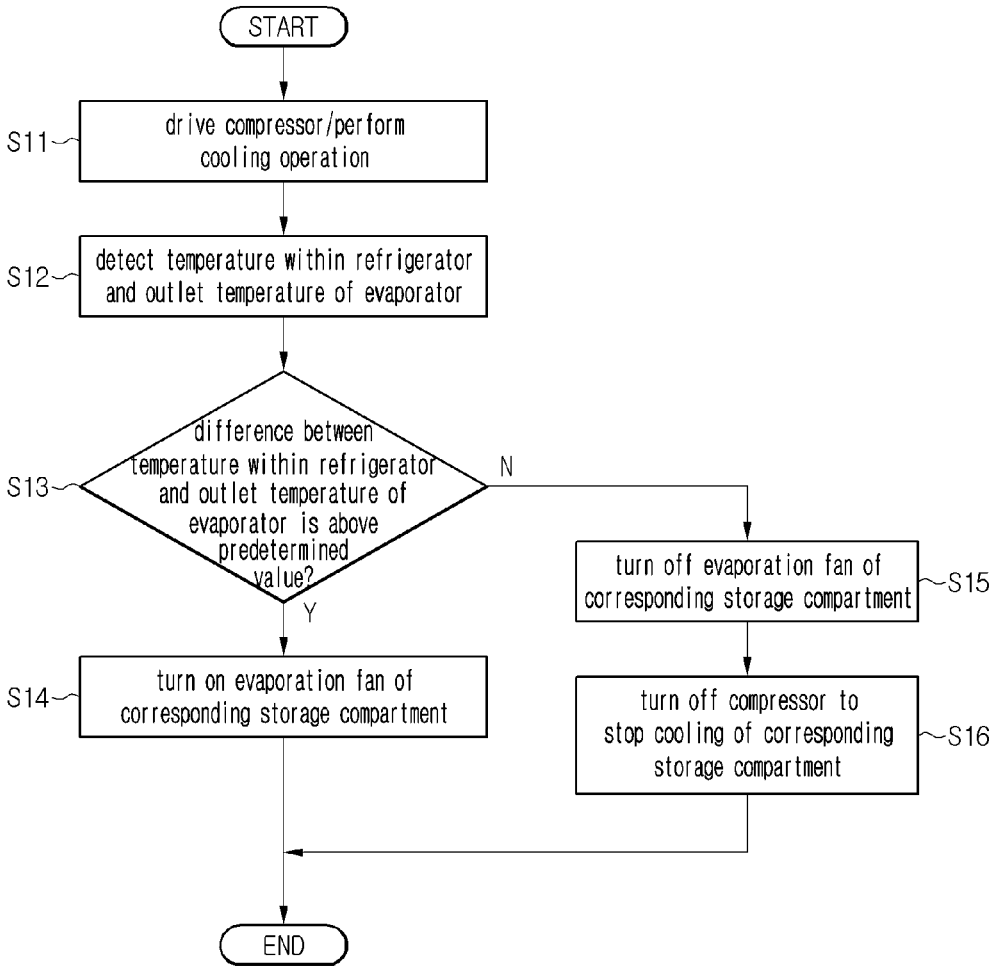
FIG. 31 is a flowchart illustrating a method of controlling a refrigerator according to an embodiment.

FIG. 31 is a flowchart illustrating a method of controlling a refrigerator according to an embodiment. Referring to FIG. 31, the method for controlling a refrigerator according to this embodiment will be described.

To operate a refrigerator, such as refrigerator 10 previously discussed, at least one compressor of first and second compressors, such as first and second compressors 811 and 815, may be operated. If a storage compartment of the refrigerator has a temperature greater than a first predetermined temperature (a desired temperature), at least one compressor may be operated. A refrigeration cycle due to the compression-condensation-expansion-evaporation of the refrigerant may operate according to the operation of the first or second compressor.

Cooling operations for a refrigerating compartment and a freezing compartment may be performed at the same time or individually according to the operation of the refrigeration cycle. For example, when the first compressor is operated alone, or the first and second compressors are operated at the same time, the cooling operations for the refrigerating compartment and the freezing compartment may be performed at the same time. On the other hand, when the second compressor operates, and the first compressor does not operate, the cooling operation for the freezing compartment may be performed alone. Whether the cooling operation for the freezing compartment or the refrigerating compartment is performed may be adjusted according to the control of a flow adjuster, such as flow adjuster 830 previously discussed, in step S11.

While the refrigeration cycle is operated, a temperature within the refrigerator and an outlet temperature of the evaporator may be detected, in step S12. The temperature within the refrigerator may be a temperature within a storage compartment in which the cooling operation is performed, and the outlet temperature of the evaporator may be a temperature of an outlet-side of the evaporator disposed in the storage compartment in which the cooling operation is performed. For example, when the refrigerating compartment operates alone, the temperature within the refrigerator may be an inner temperature of the refrigerating compartment, and the outlet temperature of the evaporator may be an outlet temperature of an evaporator, such as first evaporator 850 previously discussed.

If a difference between the temperature within the refrigerator and the outlet temperature of the evaporator is recognized, it is determined that whether the recognized difference in value is above a predetermined value, in step S14. When the difference in valve is above the predetermined value, an evaporation fan of the corresponding storage compartment may be turned on to operate, in step S14. Also, the operation of the compressor may be continuously maintained. The corresponding storage compartment may be a storage compartment in which the cooling operation is performed, and the evaporation fan may be an evaporation fan disposed at a side of the storage compartment in which the cooling operation is performed.

A case in which the difference in value is below the predetermined value may include a case in which the temperature within the refrigerator rises above a first predetermined temperature (desired temperature), and the cooling operation is required, and a case in which the temperature of the evaporator is maintained below a second predetermined temperature in which the cooling operation for the storage compartment is enabled. Thus, even though the temperature within the refrigerator is maintained below the first predetermined temperature, when a temperature of a refrigerant flowing into the evaporator is maintained below the second predetermined temperature, the evaporator may continuously operate to supply cold air, thereby utilizing waste heat, and also, the operation of the compressor may be maintained to effectively collect the refrigerant circulated in the refrigeration cycle, in steps S13, S14.

On the other hand, in step S13, when the difference in value between the temperature within the refrigerator and the outlet temperature of the evaporator is below the predetermined value, the evaporation fan of the corresponding storage compartment may be turned off to stop an operation of the evaporation fan, in step S15. To stop the cooling of the corresponding storage compartment, the compressor may be turned off, in step S16.

That is, in a state in which the temperature of the storage compartment is maintained below the first predetermined temperature, if the outlet temperature of the evaporator is maintained above the second predetermined temperature, and thus, the outlet temperature does not help the cooling of the storage compartment, or in a state in which the outlet temperature of the evaporator is maintained to the second predetermined temperature, if the temperature within the storage compartment is maintained below the first predetermined temperature, and thus, the cooling of the storage compartment is unnecessary, the evaporation fan may be turned off to stop the supply of the cold air into the corresponding storage compartment, in step S15. Also, if the temperature of the storage compartment is below the first predetermined temperature (the desired temperature), the compressor may be turned off to stop the cooling of the corresponding storage compartment, in step S16.

Figure 32A:
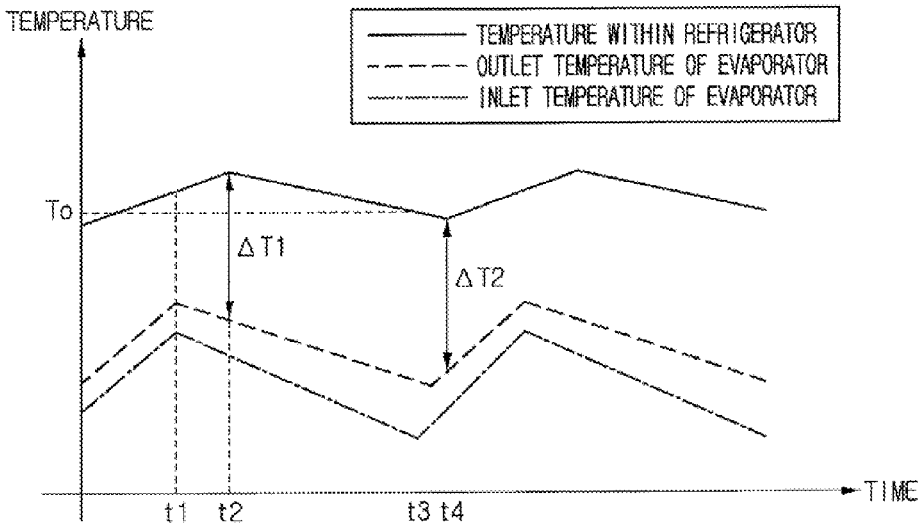
FIG. 32A is a graph illustrating time-variable temperature values for a refrigerator according to an embodiment.
Figure 32B:
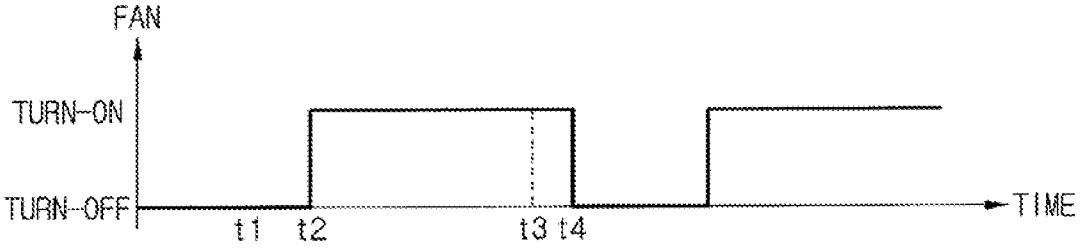
FIG. 32B is a graph illustrating a state in which an evaporator fan of a refrigerator is turned on/off depending on a variation in time according to a embodiment.
Figure 33:
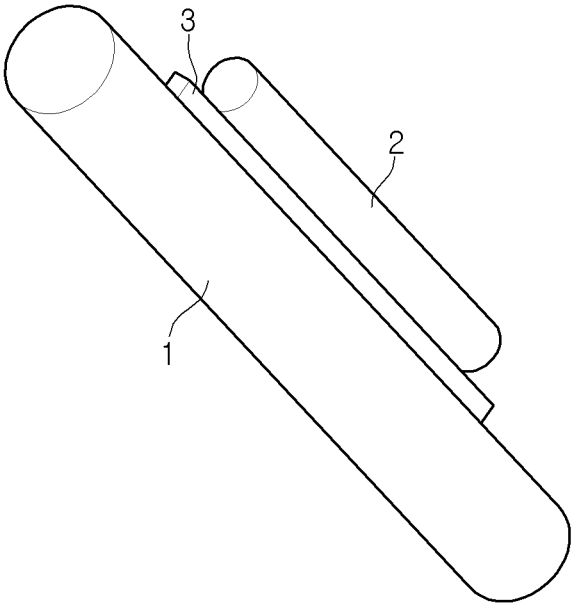
FIG. 33 is a view of a temperature sensor holder according to a related art.

FIG. 32A is a graph illustrating time-variable temperature values for a refrigerator according to an embodiment. FIG. 32B is a graph illustrating a state in which an evaporator fan of a refrigerator is turned on/off depending on a variation in time according to an embodiment.

Referring to FIGS. 32A and 32B, the first compressor or the second compressor may operate for a time t1 to perform cooling of a corresponding storage compartment. Thus, inlet and outlet temperatures of an evaporator may decrease after the time t1.

Also, a predetermined time interval may be required until a refrigeration cycle may be stabilized after the compressor operates, and the refrigeration cycle may be stabilized at a time t2. The stabilization of the refrigeration cycle may be understood as a state in which a high pressure of a refrigerant in the compressor and a low pressure of a refrigerant introduced into the compressor are controlled to be within a predetermined pressure range.

The storage compartment may increase in temperature until the refrigeration cycle is stabilized, that is, up to the time t2 after the compressor operates for the time t1. On the other hand, the temperature within the storage compartment may decrease at the time t2 due to the cooling of the storage compartment.

A difference in value ($\Delta T1$) of the temperature of the storage compartment and the outlet temperature of the evaporator may increase above a predetermined value, and thus, an evaporation fan may be turned on. As described above, as actual cooling of the storage compartment is performed for the time t2, the temperature within the refrigerator and the inlet and outlet temperatures of the evaporator may drop at the same time. Also, while the temperature within the refrigerator drops, when the temperature within the refrigerator reaches a first predetermined temperature To (a desired temperature) at a time t3, the compressor may be turned off.

When the compressor is turned off at the time t3, the inlet temperature of the evaporator may rise. On the other hand, the outlet temperature of the evaporator may rise after a predetermined time interval has elapsed because waste heat remaining in the evaporator may be utilized.

Also, while the outlet temperature of the evaporator rises, the difference in value between the temperature within the refrigerator and the outlet temperature of the evaporator may be reduced below the predetermined value. When the difference in value $\Delta T2$ is below the predetermined value, the evaporation fan may be turned off.

As the evaporation fan is turned off, the supply of the cold air into the storage compartment may be stopped, and thus, the temperature within the refrigerator may rise. A cycle (the times t1 to t4) due to the selective operation of the compressor and the evaporation fan may be repeatedly performed.

According to the above-described control method, the difference in value between the temperature within the refrigerator and the outlet temperature of the evaporator may be calculated, and then, the difference in value and the predetermined value may be compared to each other to control the operation of the evaporation fan. Therefore, waste heat of the refrigerant remaining the evaporator may be sufficiently utilized to reduce power consumption.

According to embodiments disclosed herein, as the refrigerant tube and the temperature sensor are disposed to directly contact each other, a refrigerant temperature may be accurately detected. Also, the refrigerant tube and the temperature sensor may be effectively supported by the sensor holder in a state in which the refrigerant tube and the temperature sensor directly contact each other, and the sensor holder may be easily attached or detached.

Also, as the holder of the temperature sensor has a simple structure, it may be easily manufactured and reduced in manufacturing cost. Also, as the evaporator fan may be controlled in operation on the basis of a temperature of the evaporator outlet side and a temperature within the refrigerator, waste heat in the evaporator may be utilized, and refrigerant recovery may be easy, reducing power consumption.

Embodiments disclosed herein provide a refrigerator in which a temperature of a refrigerant within a refrigerant tube is capable of being accurately detected.

Embodiments disclosed herein provide a refrigerator that may include a heat exchanger including a refrigerant tube, in which a refrigerant may flow, and a heat exchange fin in which the refrigerant tube may be inserted; a temperature sensor disposed on or at an inlet-side or outlet-side of the heat exchanger to detect a temperature of the refrigerant; and a fixing device or holder to fix a guide tube disposed on an inlet-side or outlet-side of the refrigerant tube and the temperature sensor in a state in which the guide tube is in contact with the temperature sensor.

The fixing device may include a tube support unit or support that supports the guide tube, and a sensor support unit or support that supports the temperature sensor. The tube support unit may include at least one tube rib that surrounds at least one portion of the guide tube. The sensor support unit may include at least one sensor rib that extends from the tube support unit to surround at least one portion of the temperature sensor. The tube rib may be provided in plurality, and the plurality of tube ribs may be disposed to be spaced apart from each other. Further, the sensor rib may be provided in plurality, and the plurality of sensor ribs may be disposed to be spaced apart from each other.

A contact area on which the guide tube and the temperature sensor contact each other may be defined. The tube support unit or support may include a tube shield part or shield that shields the contact area against the outside, and the sensor support unit or support may include a sensor shield part or shield that shields the contact area against the outside.

The fixing device may include a first fixing part or holder coupled to the guide tube, and a second fixing part or holder coupled to the first fixing part to support the guide tube and the temperature sensor so that the guide tube and the temperature sensor contact each other.

The refrigerator may further include a first recess part or recess provided in the first fixing part to support at least one portion of an outer circumferential surface of the guide tube, and a second recess part or recess provided in the second fixing part to support the other portion of the outer circumferential surface of the guide tube. The second fixing part may further include a sensor recess part or recess that is further recessed from the second recess part or recess to accommodate the temperature sensor.

The refrigerator may further include a hinge part or hinge that allows the first fixing part to be rotatably coupled to the second fixing part. The first fixing part, the second fixing part, and the hinge part may be integrated with each other.

The refrigerator may further include a coupling part or portion provided on one of the first fixing part and the second fixing part, and a groove in which the coupling part may be inserted. The groove may be provided in the other one of the first fixing part and the second fixing part. The first fixing part may be slidably coupled to the second fixing part.

The refrigerator may further include a hook provided on one of the first fixing part and the second fixing part, and a hook coupling part in which the hook is accommodated. The hook coupling part may pass through the other one of the first fixing part and the second fixing part.

The refrigerator may further include an outlet temperature sensor that detects a refrigerant temperature of an outlet-side of the heat exchanger, and a refrigerator temperature sensor that detects a temperature of a refrigerating compartment or freezing compartment. The refrigerator may further include a controller that turns a blower fan on when a different value or difference in value between the temperature detected by the outlet temperature sensor and the temperature detected by the refrigerator temperature sensor is above a set or predetermined value and turns the blower fan off when the different value is below the set value.

Embodiments disclosed herein further provide a refrigerator that may include a heat exchanger including a refrigerant tube, in which a refrigerant may flow, and a heat exchange fin, in which the refrigerant tube may be inserted; a temperature sensor disposed on an inlet-side or outlet-side of the heat exchanger to detect a temperature of the refrigerant; and a fixing device or holder to fix a guide tube disposed on an inlet-side or outlet-side of the refrigerant tube and the temperature sensor. The fixing device may include a first fixing part or holder that supports the guide tube, and a second fixing part or holder coupled to the first fixing part to accommodate the temperature sensor so that the guide tube and the temperature sensor contact each other.

The refrigerator may further include a first recess part or recess defined in the first fixing part to support at least one portion of the guide tube, a second recess part or recess defined in the second fixing part to support at least one portion of the guide tube, and a sensor recess part or recess further recessed from the second recess part to accommodate the temperature sensor. The second fixing part may be rotatably coupled to the first fixing part.

The refrigerator may further include a hook provided on the first fixing part and a hook coupling part or portion provided on the second fixing part. The hook coupling part may be coupled to the hook, and the hook may include a rail that moves along the hook coupling part.

The refrigerator may further include a frame that extends from the fixing device to support the guide tube, and a separation prevention rib provided on the frame to support one side of the guide tube, thereby preventing the guide tube from being separated.

Embodiments disclosed herein may further provide a method for controlling a refrigerator that may include driving a compressor; detecting a temperature of a storage compartment in the refrigerator and an outlet temperature of an evaporator; recognizing whether a different value or difference in value between the temperature of the storage compartment and the outlet temperature of the evaporator is above a set or predetermined value; and turning an evaporation fan on when the different value is above the set value and turning off the evaporation fan when the different value is below the set value.

The method may further include, when the temperature of the storage compartment is below a first set or predetermined temperature, stopping an operation of a compressor. When a temperature of a refrigerant flowing into the evaporator is maintained below a second set or predetermined temperature even though the temperature of the storage compartment is maintained below the first set temperature, the evaporation fan may be turned on.

When an outlet temperature of the evaporator is maintained above the second set temperature in the state in which the temperature of the storage compartment is maintained below the first set temperature, or when the temperature of the storage compartment is maintained below the first set temperature in the state where the outlet temperature of the evaporator is maintained below the second set temperature, the evaporation fan may be turned off.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger assembly, comprising:

a heat exchanger including a refrigerant tube, in which a refrigerant flows, and at least one heat exchange fin, into which the refrigerant tube is inserted;

a temperature sensor provided on an inlet-side or an outlet-side of the heat exchanger to detect a temperature of the refrigerant; and a sensor holder to fix a guide tube provided on an inlet-side or an outlet-side of the refrigerant tube and the temperature sensor in a state in which the guide tube is in contact with the temperature sensor, wherein the sensor holder includes:

a first frame including first and second straight portions and a first rounded portion disposed between the first and second straight portions;

at least one tube rib provided at the first straight portion to support the guide tube, the at least one tube rib being rounded and having a first radius of curvature to surround at least a first portion of the guide tube;

a second frame spaced apart from the first frame and including third and fourth straight portions and a second rounded portion disposed between the third and fourth straight portions;

at least one sensor rib provided at the third straight portion and connected with the at least one tube rib to support the temperature sensor, the at least one sensor rib being rounded and having a second radius of curvature to surround at least a portion of the temperature sensor;

at least one guide rib that extends towards the fourth straight portion of the second frame from the second straight portion of the first framed, the at least one guide rib being spaced apart from the at least one rube rib and the at least one sensor rib, the at least one guide rib being configured to support a second portion of the guide tube which is not in contact with the temperature sensor; and at least one reinforcing rib that extends towards the second rounded portion of the second frame from the first rounded portion of the first frame.

2. The heat exchanger assembly according to claim 1, wherein the at least one tube rib includes a plurality of tube ribs, provided spaced apart from each other, and wherein the at least one sensor rib includes a plurality of sensor ribs provided spaced apart from each other.

3. The heat exchanger assembly according to claim 1, further including a plurality of support protrusions that extends from the first or second frame to support the guide tube and the temperature sensor, respectively.

4. The heat exchanger assembly according to claim 1, wherein the guide tube includes a curved guide tube.

5. A refrigerator comprising the heat exchanger assembly according to claim 1.

6. The refrigerator according to claim 5, further including:

an outlet temperature sensor to detect a refrigerant temperature of the outlet-side of the heat exchanger; and a refrigerator temperature sensor to detect a temperature of a refrigerating compartment or a freezing compartment of the refrigerator.

7. The heat exchanger assembly according to claim 6, further including a controller to turn a blower fan on when a difference in value between the temperature detected by the outlet temperature sensor and the temperature detected by the refrigerator temperature sensor is above, a predetermined value and turn the blower fan off when the difference in value is below the predetermined value.

* * * * *